US005361463A

United States Patent [19]

Revis

[11] Patent Number: 5,361,463

[45] Date of Patent: Nov. 8, 1994

[54] ONE PIECE SPRING CLIP

[76] Inventor: Arthur N. Revis, 1235 D'Amico Dr., Chicago Heights, Ill. 60411

[21] Appl. No.: 50,899

[22] Filed: Apr. 21, 1993

[51] Int. Cl.[5] ..... A44B 21/00

[52] U.S. Cl. ..... 24/543; 24/499; 24/557

[58] Field of Search ..... 24/543, 499, 508, 557, 24/562, 545

[56] References Cited

U.S. PATENT DOCUMENTS

| | | | |
|---|---|---|---|
| 3,629,912 | 12/1971 | Klopp | 24/543 |
| 3,733,656 | 5/1973 | Stalder | 24/557 |
| 4,290,575 | 9/1981 | Swartwout | 248/316 D |
| 4,335,838 | 6/1982 | Bisk et al. | 223/91 |
| 4,762,296 | 8/1988 | Kraus et al. | 24/543 |
| 4,763,390 | 8/1988 | Rooz | 24/557 |
| 4,839,947 | 6/1989 | Cohen et al. | 24/499 |
| 4,840,341 | 6/1989 | Hasegawa | 248/316.5 |
| 4,899,974 | 2/1990 | Wear et al. | 248/467 |
| 5,199,140 | 4/1993 | Valiulis et al. | 24/562 |

FOREIGN PATENT DOCUMENTS

| | | | |
|---|---|---|---|
| 2278006 | 2/1976 | France | 24/557 |

*Primary Examiner*—Victor N. Sakran
*Attorney, Agent, or Firm*—Milton S. Gerstein

[57] ABSTRACT

The basic clip enclosed is a one piece plastic clip formed by an upper and lower face beam having gripping jaws. The face beams are joined together by a shared biasing traverse support member that operates in conjunction with a pivotal locking tip and locking receptacle. Final assembly of the clip is performed by pressing the face beams together which engages the pivotal locking tip with the latching body allowing the jaw elements to lock in a closed position. Continued squeezing of the proximal end portions allows the traverse support member to arc beyond the design angle forcing the jaws into a larger spaced apart position. To prevent stressing and allow shaft mountings, the traverse support member utilizes fingers to provide interference with complete compression. Variations of the transverse support member and clip closure beams are also enclosed.

12 Claims, 15 Drawing Sheets

FIG. 37
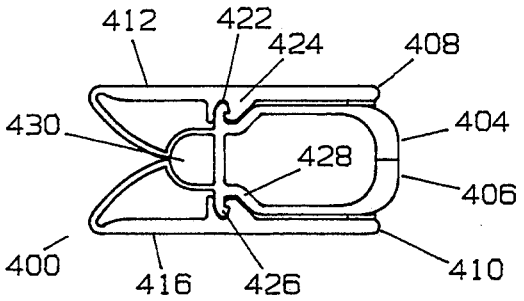
FIG. 35
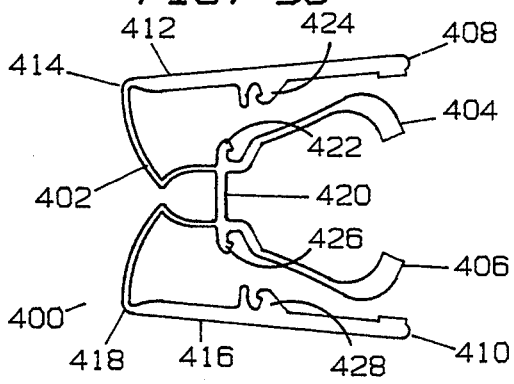
FIG. 38
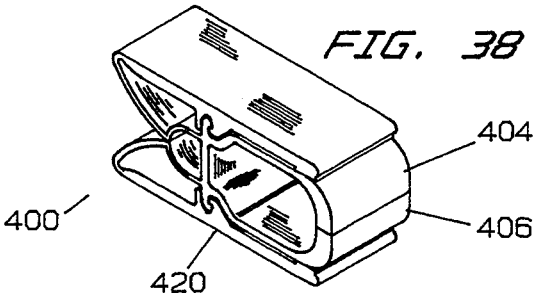
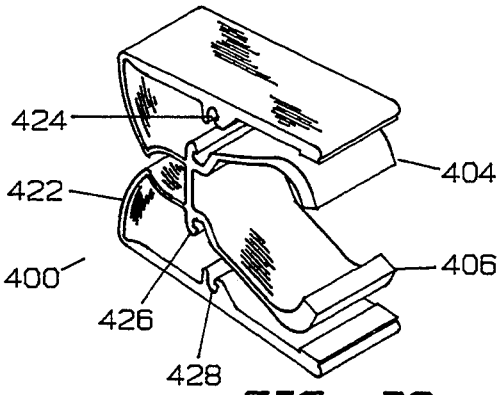
FIG. 36
FIG. 41
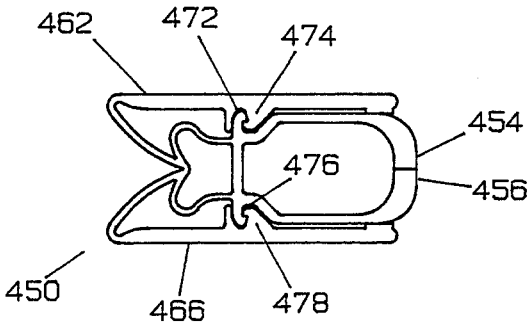
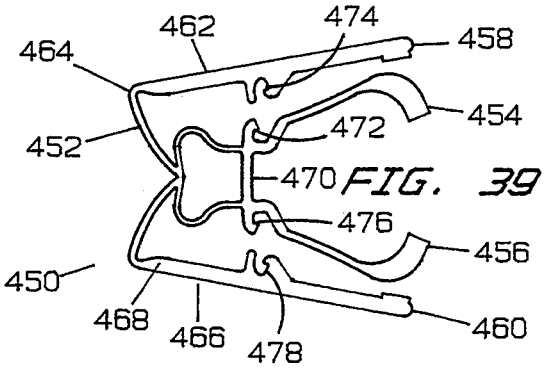
FIG. 39
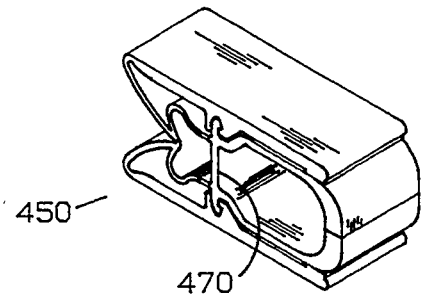
FIG. 42
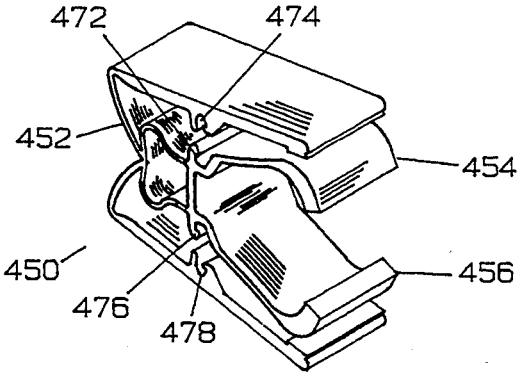
FIG. 40

FIG. 43
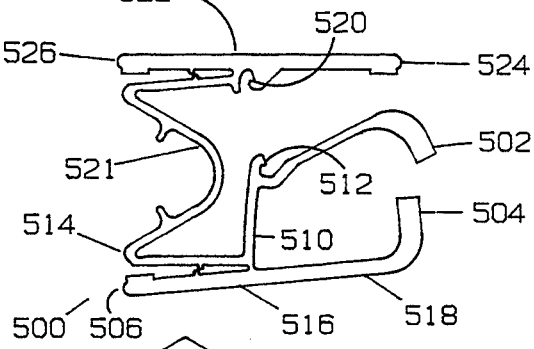
FIG. 45
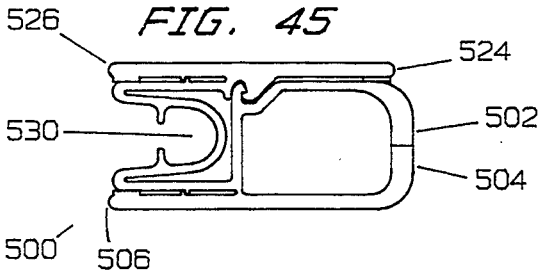
FIG. 46
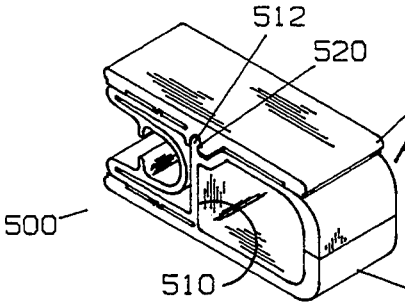
FIG. 44
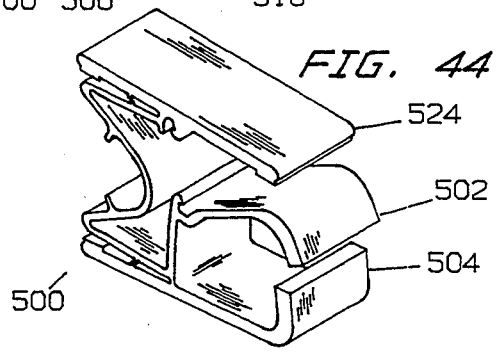
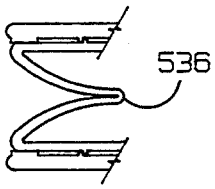
FIG. 47
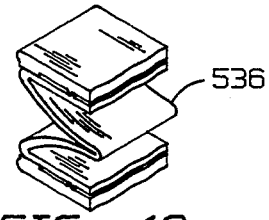
FIG. 48
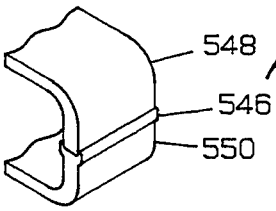
FIG. 51
FIG. 49
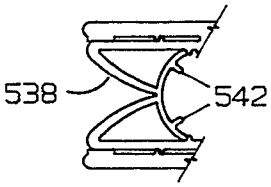
FIG. 50
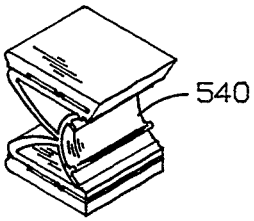
FIG. 52
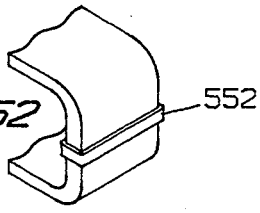
FIG. 53
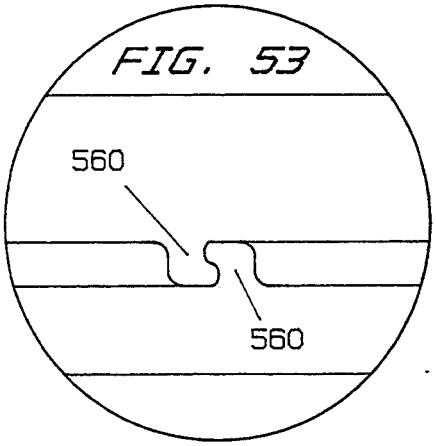
FIG. 54
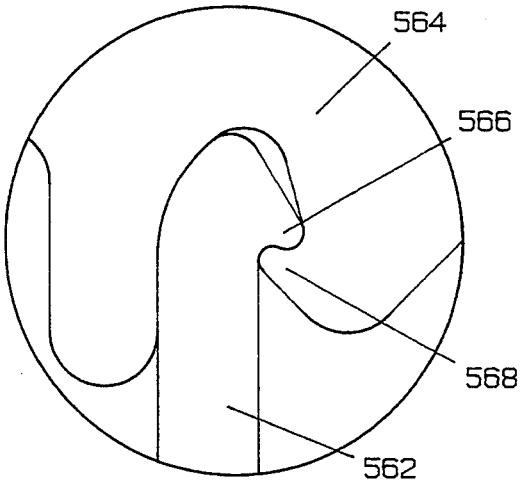

FIG. 57
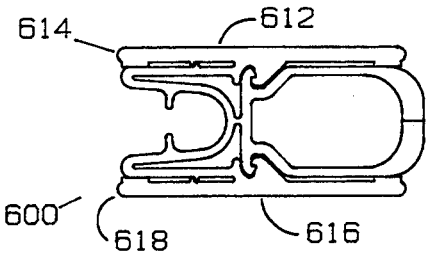
FIG. 55
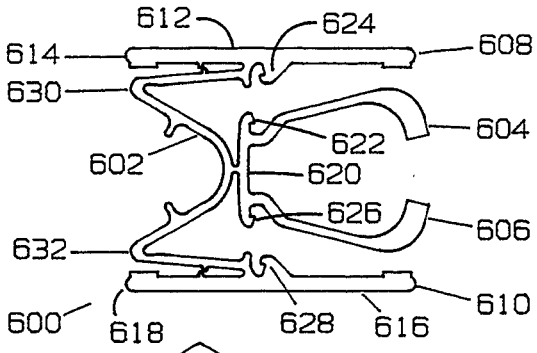
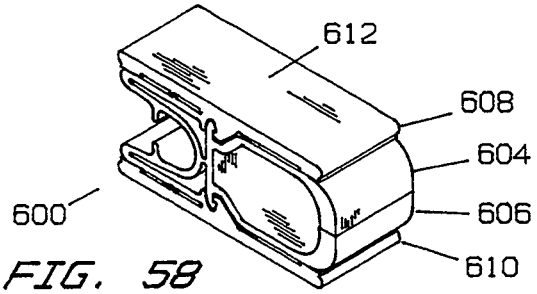
FIG. 58
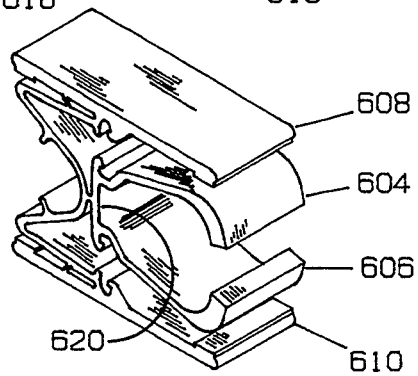
FIG. 56
FIG. 59
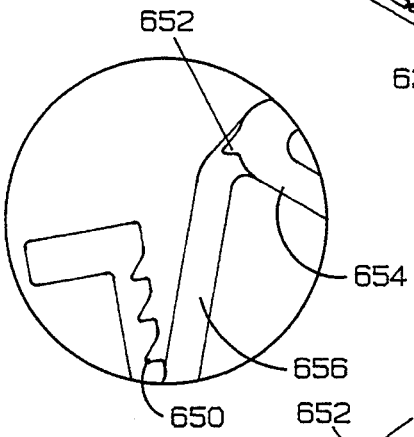
FIG. 62
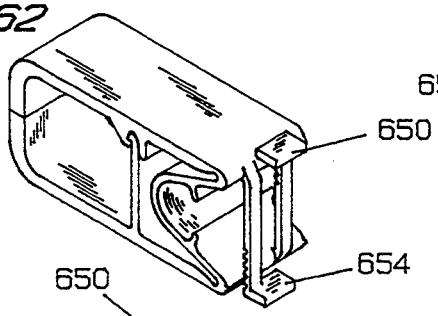
FIG. 60
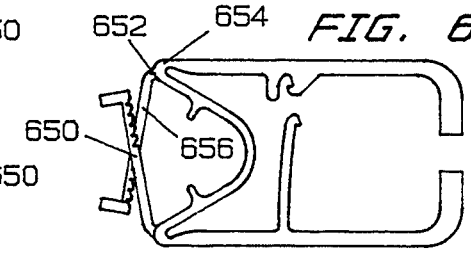
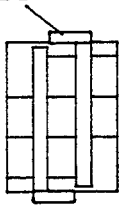
FIG. 63
FIG. 61
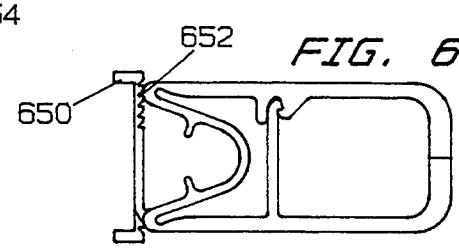

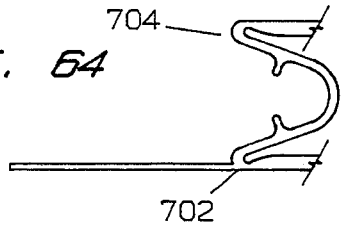
FIG. 64
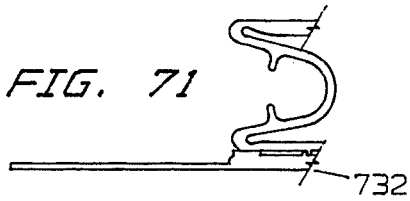
FIG. 71
FIG. 72
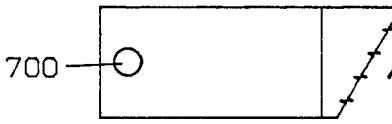
FIG. 65
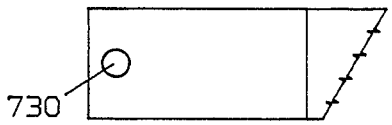
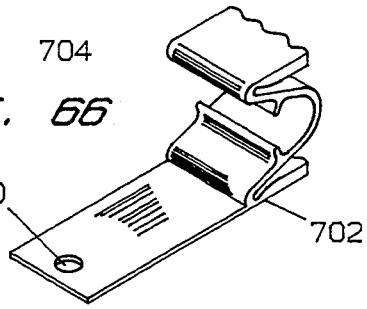
FIG. 66
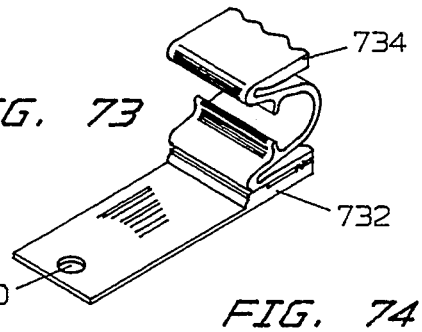
FIG. 73
FIG. 74
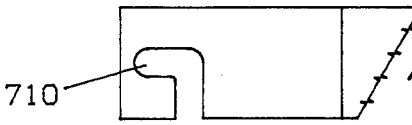
FIG. 67
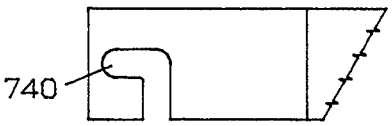
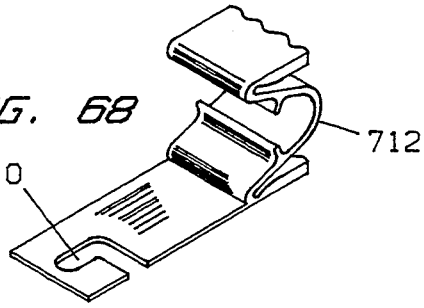
FIG. 68
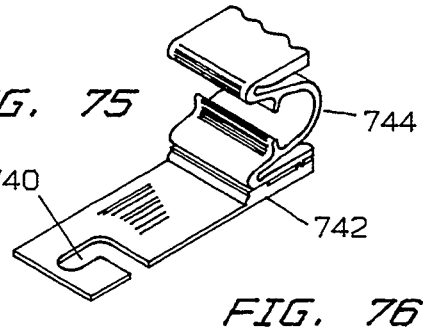
FIG. 75
FIG. 76
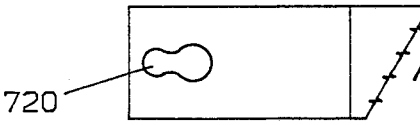
FIG. 69
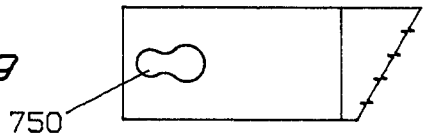
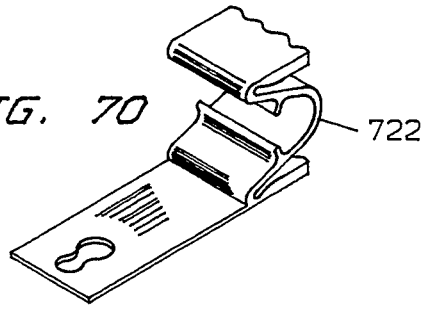
FIG. 70
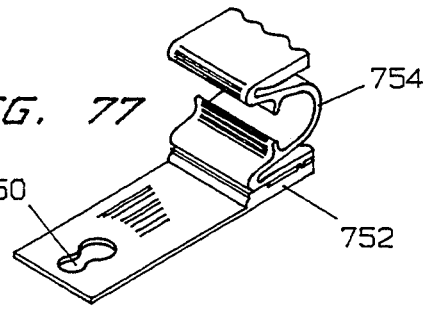
FIG. 77

FIG. 97
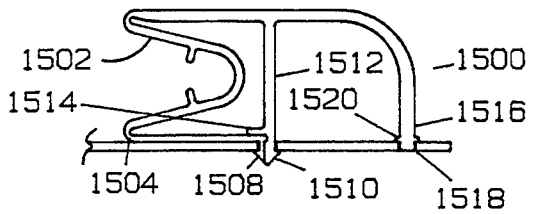
FIG. 95
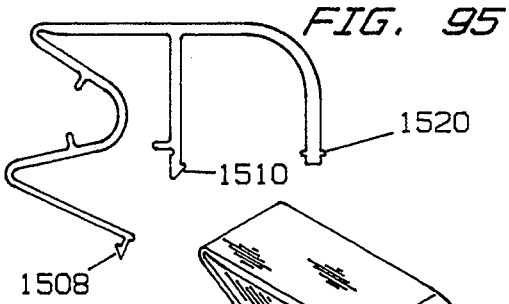
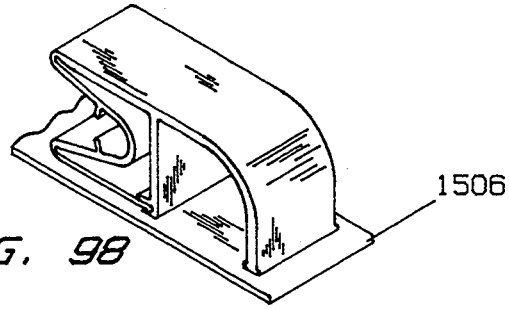
FIG. 98
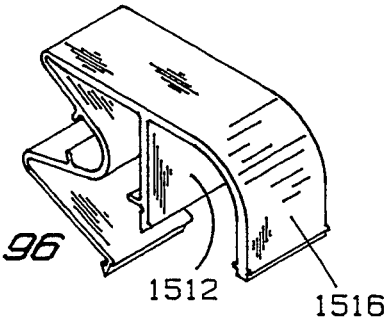
FIG. 96
FIG. 101
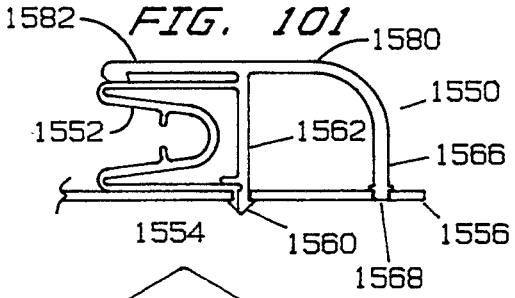
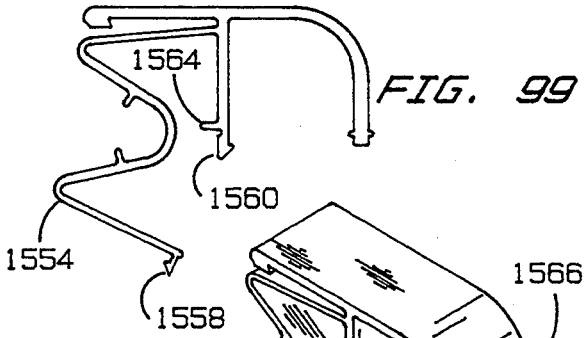
FIG. 99
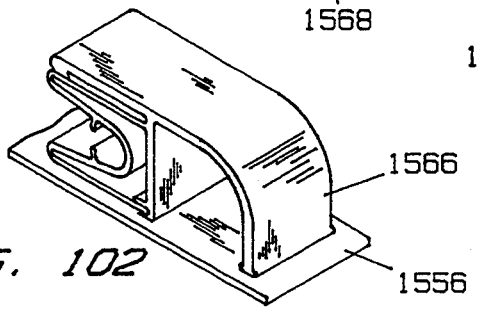
FIG. 102
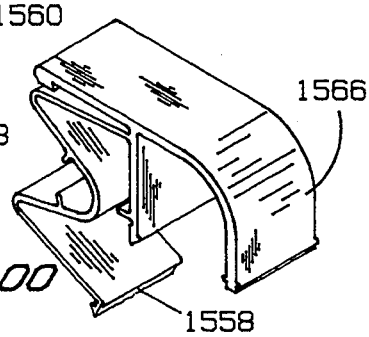
FIG. 100
FIG. 105
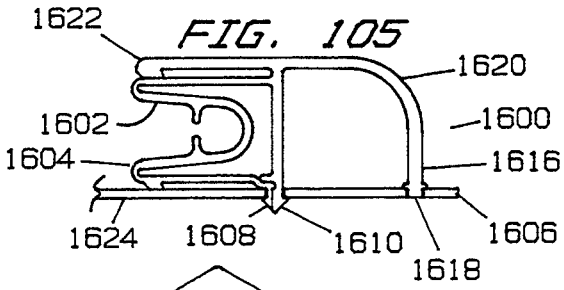
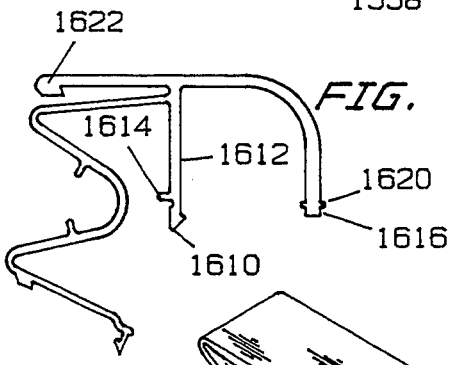
FIG. 103
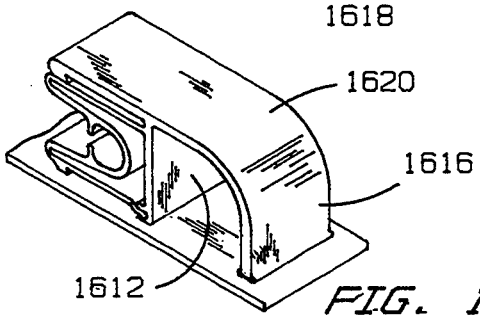
FIG. 106
FIG. 104
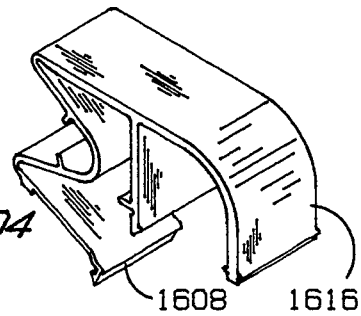

FIG. 107
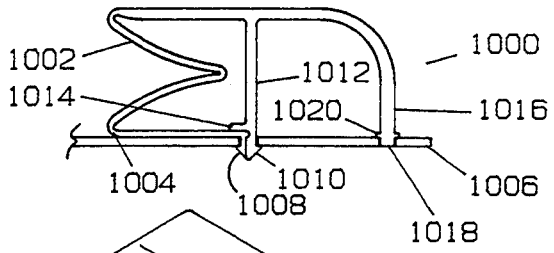
FIG. 108
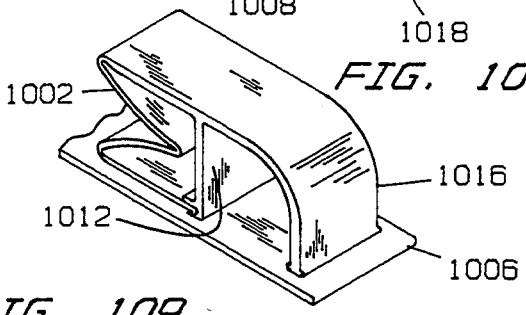
FIG. 109
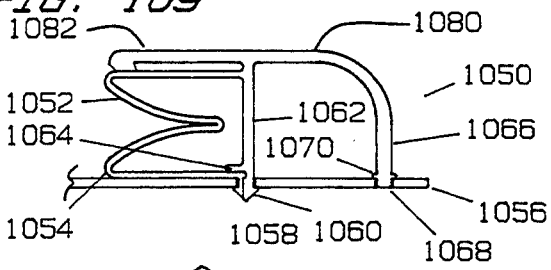
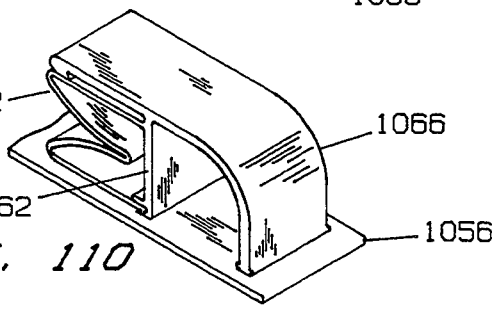
FIG. 110
FIG. 111
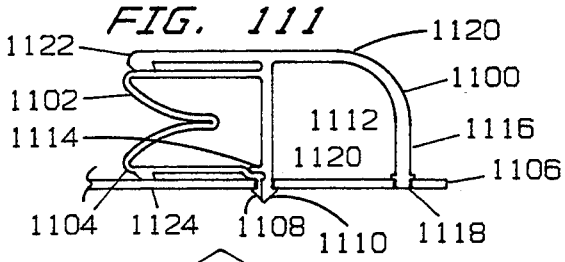
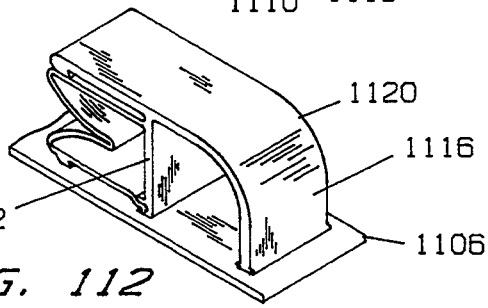
FIG. 112
FIG. 113
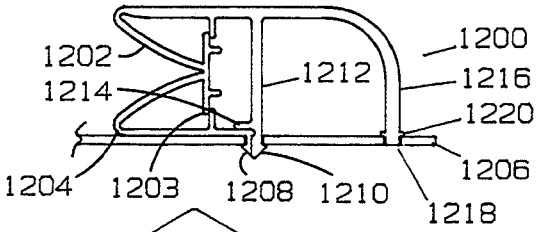
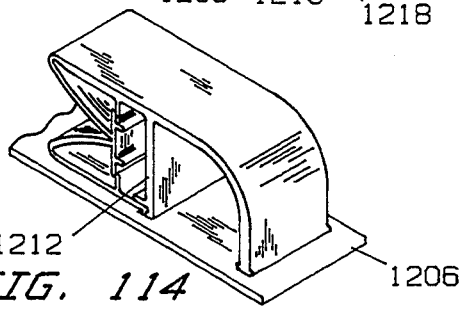
FIG. 114
FIG. 115
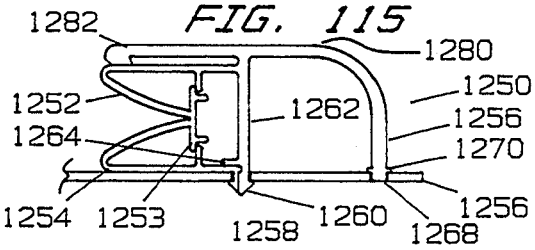
FIG. 116
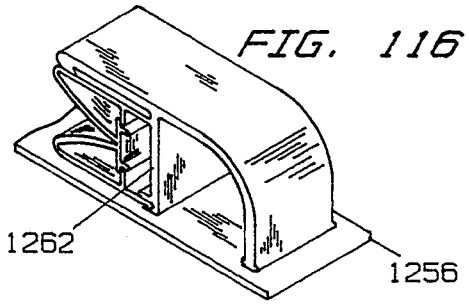
FIG. 117
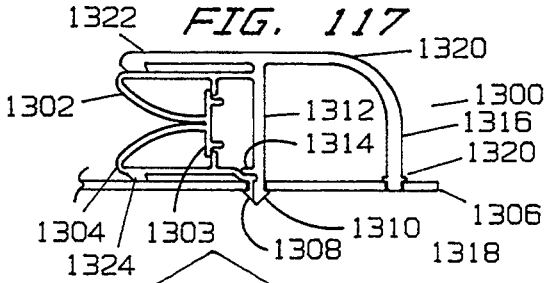
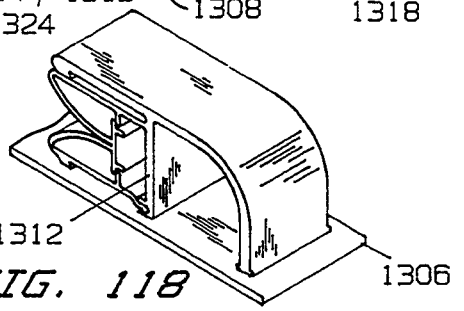
FIG. 118

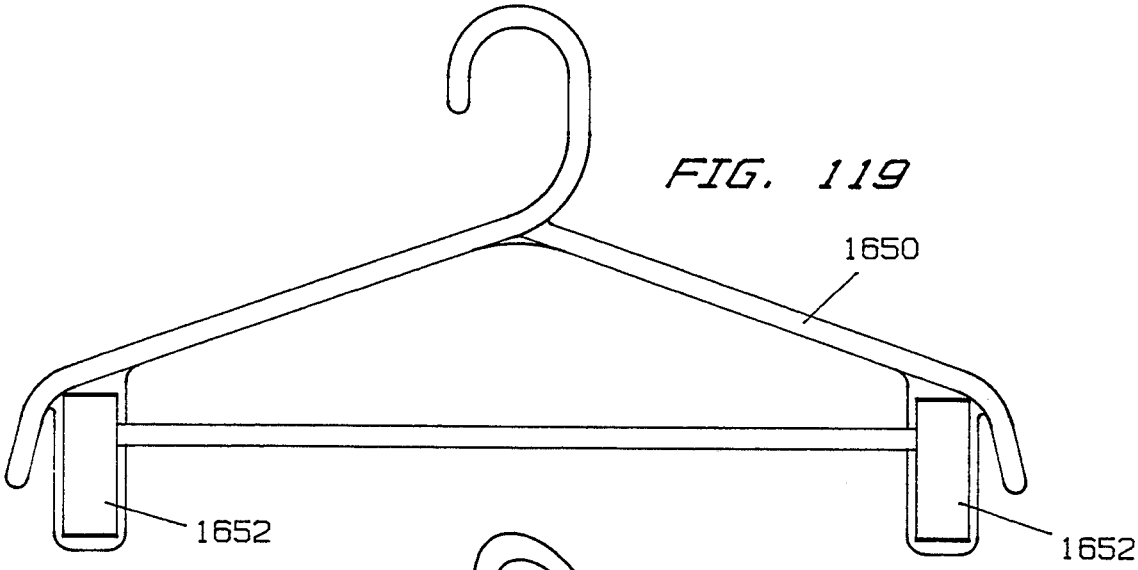
FIG. 119
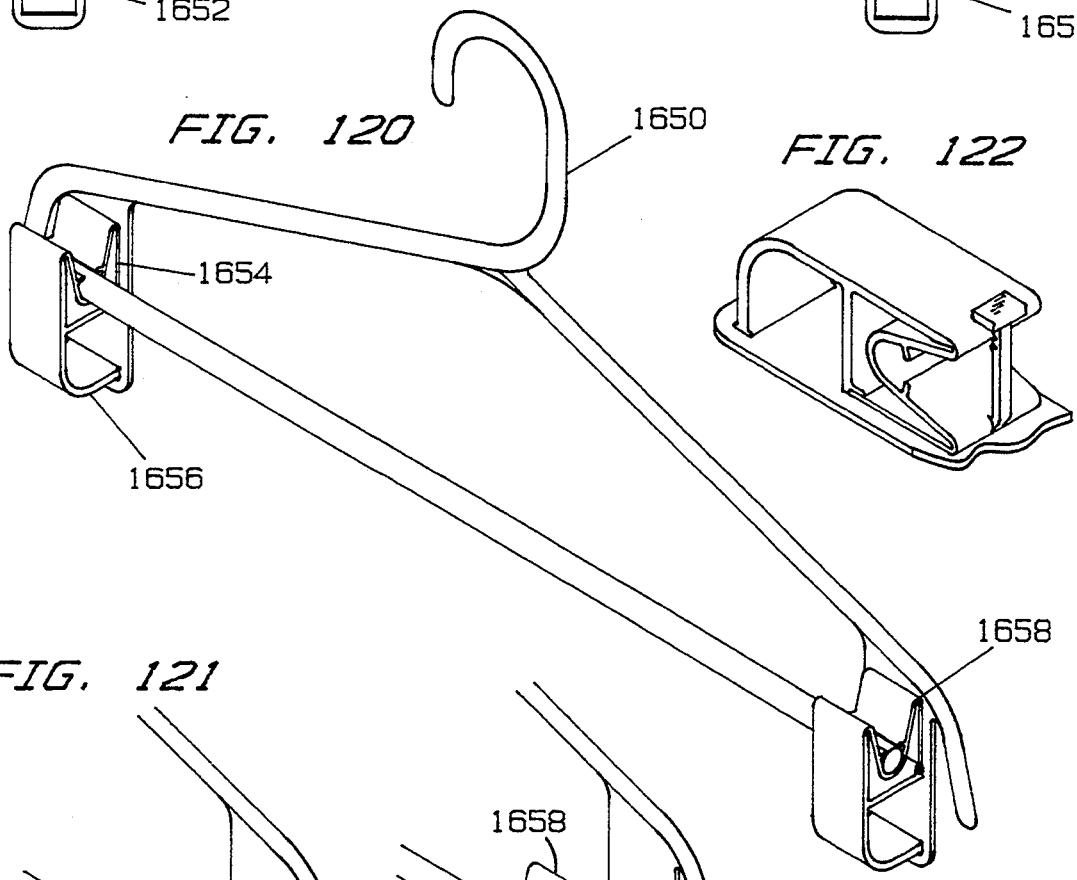
FIG. 120
FIG. 122
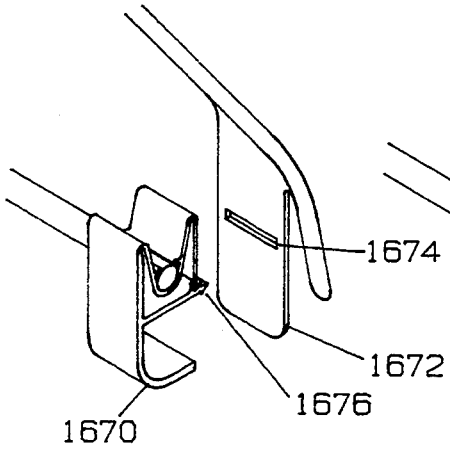
FIG. 121
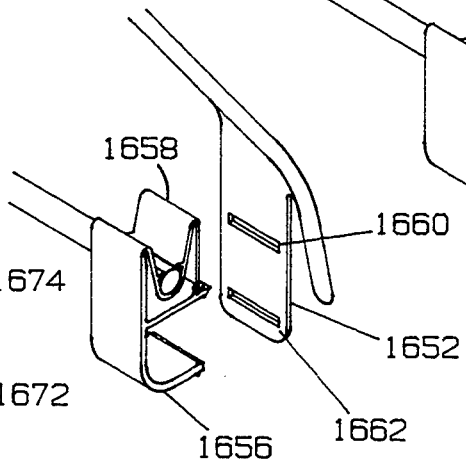
FIG. 123

FIG. 125
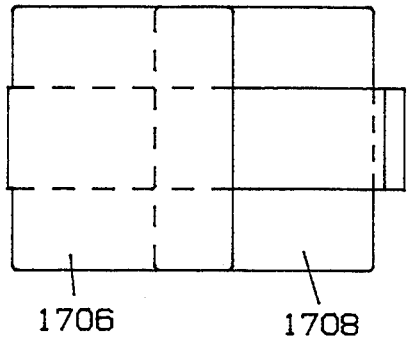
FIG. 123
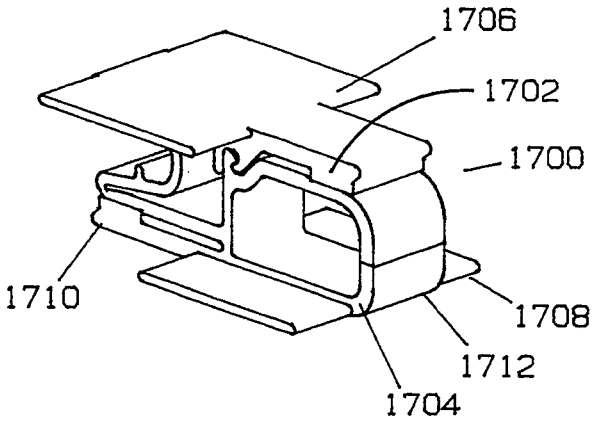
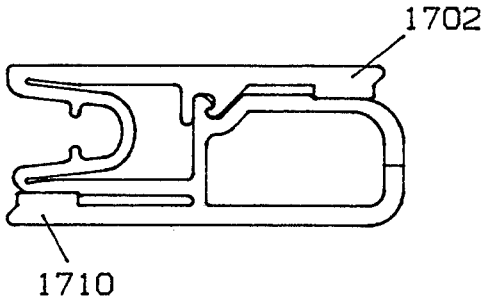
FIG. 126
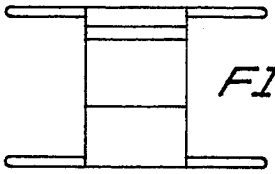
FIG. 124
FIG. 129
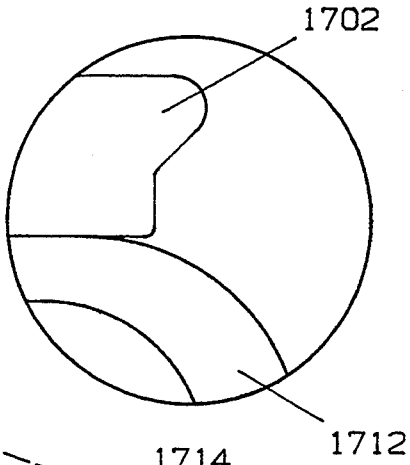
FIG. 127
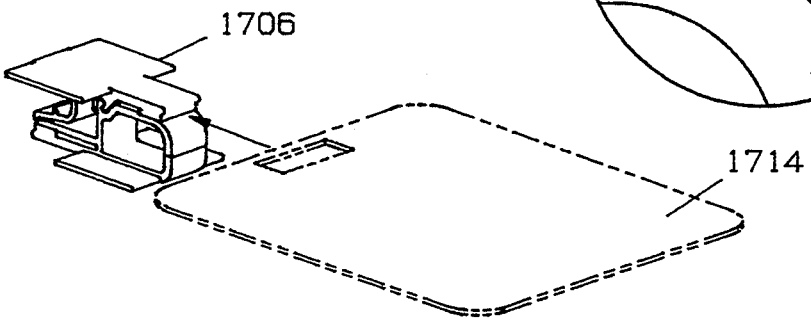
FIG. 128
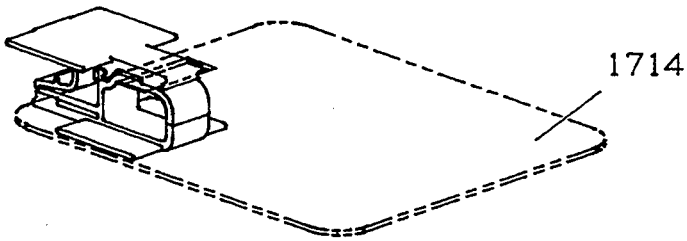

ONE PIECE SPRING CLIP

FIELD OF THE INVENTION

This invention relates generally to spring clips for holding items, and more particularly, to a new and improved single piece plastic clip having an integrated latching feature.

DESCRIPTION OF THE PRIOR ART

Spring clips are well known in the art. Such clips are used for holding badges, memos, documents, clothing, and anything else that will fit between the jaws of the clip.

Variations of the spring clip include materials of construction, jaw size, methods of attaching the clip to fixtures, and various methods to accomplish the biasing of the jaws in a closed position. For instance, a typical clip found in any home is constructed of plastic, sized to hold multiple sheets of paper, incorporates a magnet for attachment to a refrigerator door, and utilizes a metal pintle-type spring for biasing the jaws of the clip in a closed position. Most office clips have multiple parts involving wire axis and coil springs that must be compressed manually during assembly operation. Incorporating the biasing mechanism into the body of the clip, as in a flexible metal closure, is also used to permanently bias the jaws in a closed position.

Such clips, and the numerous variations thereto, all require multiple parts making assembly time consuming especially if the variation requires the bending of parts for assembly. Prior art clips made exclusively of plastic, wherein the biasing means is a molded plastic internal clip whose resiliency permits replacement of the conventional spring, is made of plastic whose resiliency is separate than the clip itself. Further, since the biasing means is made separate from the clip, the cost of clip manufacture is increased.

The aforementioned clips all require the operator to physically force the jaws open, against the spring or plastic band tension, to place an item within the jaws. Thus, in addition to the aforementioned problems, a major limitation of the prior art is that the jaws are always biased in a closed position.

Thus, what is lacking in the art is a clip that can remain in a biased or unbiased position and includes a means for locking the clip in either position.

SUMMARY OF THE INVENTION

The present invention is a single piece plastic clip having a resilient biasing member formed between the base members of axial spaced apart jaws.

The clip is constructed of a single piece of molded plastic having two axially spaced jaw members that can be manually separated by squeezing an outer portion of the clip which opens the jaws simultaneously.

Thus, a primary objective of the instant invention is to provide a complete clip from a single step of manufacturing including the biasing mechanism, jaws, leverage handles, and a locking mechanism from a single piece of material thereby eliminating additional assembly.

Yet another object of the instant invention is to provide various traverse support member designs all of which are capable of eliminating separate spring biasing components and retain shafting without the need for a conventional clip-jaw.

Another object of the instant invention is to place the center of gravity at the rear of the clip allowing the weight of the clip to orient its primary jaws downward for ease of attachment to garment when assembled around a clothes-hanger cross-bar. This orientation allows the clip to remain in a stationary position for optimum indicia display.

Still another object of the instant invention is to provide a clip that has primary and secondary jaws.

Yet still another object of the instant invention is to provide all clip faces in a parallel position to one another for optimum indicia display and/or for attachment of adhesive or magnetic materials.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 18 is a perspective view of FIG. 17;

FIG. 35 is a side view of the eighth embodiment having a shafting holder which approximates the V-shaped traverse support member with a stirrup, having two front facing secondary jaws, one primary jaw set, and two latching receptacles;

FIG. 36 is a perspective view of FIG. 35;

FIG. 37 is a side view of the eighth embodiment in a closed position;

FIG. 38 is a perspective view of FIG. 37;

FIG. 39 is a side view of the ninth embodiment having a combination V-shaped and plumber's force-cup profile creating a compound primary traverse support member, with two front facing secondary jaws, one primary jaw set, and two latching receptacles;

FIG. 40 is a perspective view of FIG. 39;

FIG. 41 is a side view of the ninth embodiment in a closed position;

FIG. 42 is a perspective view of FIG. 41;

FIG. 43 is side view of a tenth embodiment of the clip having a rear facing lower secondary jaw coupled to the pivotal arm, an upper rear facing secondary jaw, an upper, front facing secondary jaw set and a set of front facing primary jaws;

FIG. 44 is a perspective view of FIG. 43;

FIG. 45 is a side view of the tenth embodiment in a closed position;

FIG. 46 is a perspective view of FIG. 45;

FIG. 47 is a partial side view of a V-shaped traverse support member that may be substituted for the U-shaped traverse support member shown in FIGS. 11–28;

FIG. 48 is a perspective view of the profile shown in FIG. 47;

FIG. 49 is a partial side view of a compound primary traverse support member having a V-shape joined to an arc support member;

FIG. 50 is a perspective view of FIG. 49;

FIG. 51 is a perspective view of a stress relieving two sided pocket;

FIG. 52 is a perspective view of a four sided stress relieving pocket;

FIG. 53 is an exploded partial view of the finger protrusions;

FIG. 54 is an exploded partial view of the locking tip and latching body;

FIGS. 55–58 show an additional embodiment of the invention;

FIG. 59 is an exploded view of a ratchet toothed arm;

FIG. 60 is a side view of an open clip with the ratchet toothed arm;

FIG. 61 is a side view of a closed clip with the ratchet toothed arm;

FIG. 62 is a rear perspective view of FIG. 61;

FIG. 63 is an end view of FIG. 61;

FIG. 64 is a side view of button hole attachment that can be formed on a basic clip;

FIG. 65 is a top view of FIG. 64;

FIG. 66 is a perspective view of FIG. 64;

FIG. 67 is a top view of a slotted button hole attachment that can be formed on a basic clip;

FIG. 68 is a perspective view of FIG. 67;

FIG. 69 is a top view of a elongated button hole attachment that can be formed on a basic clip;

FIG. 70 is a perspective view of FIG. 69;

FIG. 71 is a side view of button hole attachment that can be formed on a rear facing secondary jaw of a clip;

FIG. 72 is a top view of FIG. 71;

FIG. 73 is a perspective view of FIG. 71;

FIG. 74 is a top view of a slotted button hole attachment that can be formed on a rear facing secondary jaw of a clip;

FIG. 75 is a perspective view of FIG. 74;

FIG. 76 is a top view of a elongated button hole attachment that can be formed on a rear facing secondary jaw of clip;

FIG. 77 is a perspective view of FIG. 76;

FIG. 95 is a side view of a clip for use with a substrate;

FIG. 96 is a perspective view of FIG. 95;

FIG. 97 is a side view of the clip shown in FIG. 95 with a substrate;

FIG. 98 is a perspective view of FIG. 97;

FIG. 99 is a side view of a clip with a rear facing jaw member for use with a substrate;

FIG. 100 is a perspective view of FIG. 99;

FIG. 101 is a side view of the clip shown in FIG. 99 with a substrate;

FIG. 102 is a perspective view of FIG. 101;

FIG. 103 is a side view of a clip with a two rear facing jaw members for use with a substrate;

FIG. 104 is a perspective view of FIG. 103;

FIG. 105 is a side view of the clip shown in FIG. 103 with a substrate;

FIG. 106 is a perspective view of FIG. 105;

FIG. 107 is a side view of a clip with a V-shaped traverse support member for use with a substrate;

FIG. 108 is a perspective view of FIG. 107;

FIG. 109 is a side view of a clip with a V-shaped traverse support member and rear facing jaw member for use with a substrate;

FIG. 110 is a perspective view of FIG. 109;

FIG. 111 is a side view of a clip with a V-shaped traverse support member and two rear facing jaw members for use with a substrate;

FIG. 112 is a perspective view of FIG. 111;

FIG. 113 is a side view of a clip with a V-shaped traverse support member and upright compression plate for use with a substrate;

FIG. 114 is a perspective view of FIG. 113;

FIG. 115 is a side view of a clip with a V-shaped traverse support member and upright compression plate with a single rear facing jaw member for use with a substrate;

FIG. 116 is a perspective view of FIG. 115;

FIG. 117 is a side view of a clip with a V-shaped traverse support member and upright compression plate with two rear facing jaw members for use with a substrate;

FIG. 118 is a perspective view of FIG. 117;

FIG. 119 is front view of clothes hanger having flat substrate panels at each end;

FIG. 120 is a perspective view of a clothes hanger with half clips attached;

FIG. 121 is an exploded view of a single point attachment half clip;

FIG. 122 is an exploded view of a ratchet toothed locking bar attachment for a half clip;

FIG. 123 is a perspective view of a badge clip;

FIG. 124 is an end view of FIG. 123;

FIG. 125 is a top view of FIG. 123;

FIG. 126 is a side view of FIG. 123;

FIG. 127 is a perspective view of a badge in attachment to the badge clip of FIG. 123;

FIG. 128 is a perspective view of a badge attached to the badge clip;

FIG. 129 is an exploded view of the attachment point for a badge;

FIG. 130 is a perspective view of a clip with a U-shaped traverse member coupled to a shaft;

FIG. 131 is a side view of FIG. 130;

FIG. 132 is a perspective view of a clip with a V-shaped traverse member coupled to a shaft;

FIG. 133 is a side view of FIG. 132;

FIG. 134 is a perspective view of a clip with a complex V-shaped traverse member coupled to a shaft;

Figure 134:
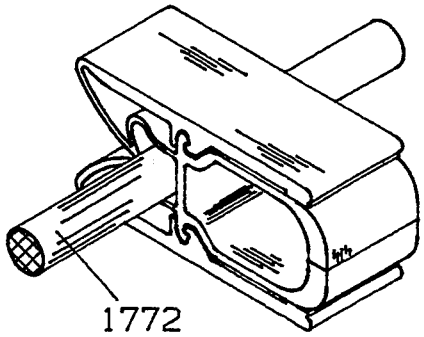
Figure 135:
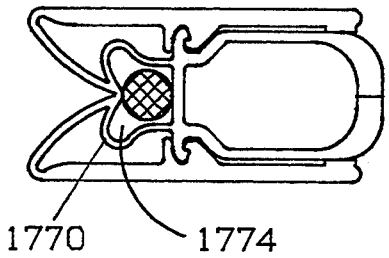
Figure 136:
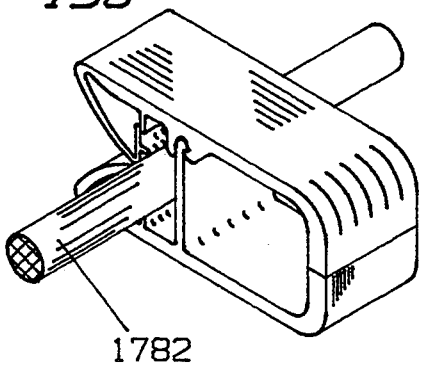
Figure 137:
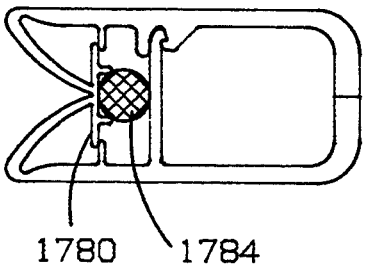

FIG. 135 is a side view of FIG. 134;

FIG. 136 is a perspective view of a clip with an upright traverse member coupled to a shaft; and FIG. 137 is a side view of FIG. 136.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
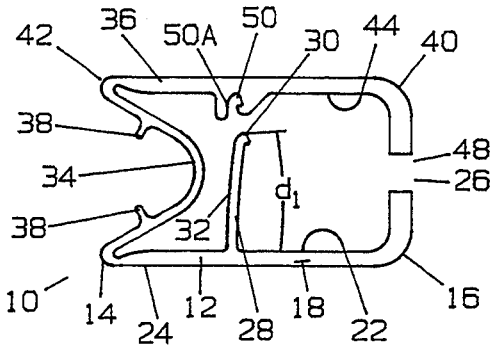
FIG. 1 is a side view of a clip of the instant invention in a pre-assembled state immediately after manufacture.
Figure 2:
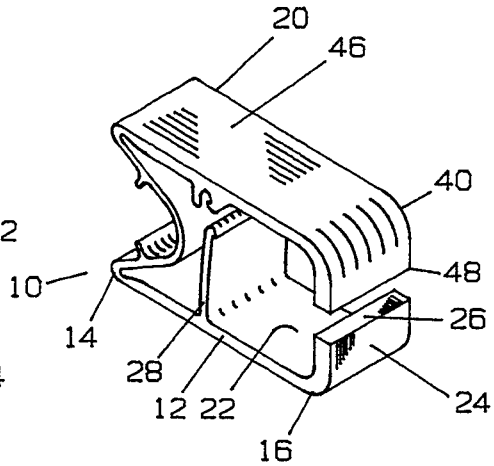
FIG. 2 is a perspective view of the clip shown in FIG. 1.

Now referring to the drawings beginning with FIGS. 1 and 2, reference numeral 10 indicates a one piece clip formed from a single piece of plastic which is shown just prior to the final assembly of the clip. A lower face beam 12 is defined by proximal end 14 and distal end 16, side edges 18, 20 and inner side surface 22 and outer side surface 24. The distal end portion 16 having a substantially right angled lower jaw element 26 extending upwardly from the inner surface and a pivotal means defined as a primary cross bar 28 having a height $d_1$ and a latching hook 30 on the leeward tip of the bar 28 which together with a slight bow 32, as described later in this specification, is operatively associated with a latching receptacle.

The proximal end 14 forms a first half portion of a traverse support member 34 which biases the lower face beam 12 with an upper face beam 36. The traverse support member 34 operates like a resilient spring using protruding fingers 38 preventing the traverse support member 34 to compress beyond the stress bearing ability of the member. In addition, fingers 38 provide for the use of shaft, clothes line, or the line cylindrical attachment to the clip.

The upper face beam 36 is defined by proximal end 40 and distal end portion 42, side edges 18, 20 and inner side surface 44 and outer side surface 46. The distal end portion 40 of the upper face beam 36 includes a substantially right angled upper jaw element 48 extending downwardly from the inner surface 44 of the upper face beam 36. A locking means is provided by a latch receptacle 50 made available for coupling the tip 30 into the latch receptacle 50. The proximal end 42 forms the second half portion of the traverse support member 34 biasing the upper face beam 36 to the lower face beam 12.

Figure 3:
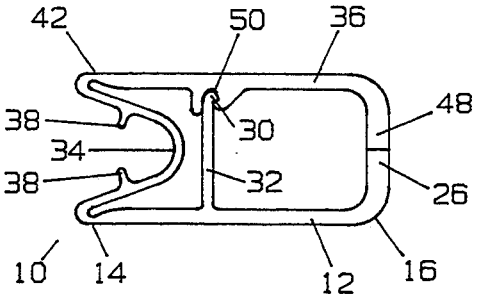
FIG. 3 is a side view of the clip shown in FIG. 1 in its assembled, bias-closed state in a closed position.
Figure 4:
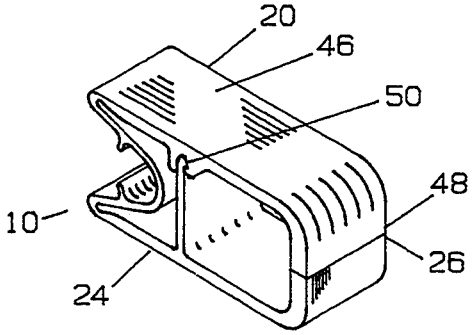
FIG. 4 is a perspective view of the clip shown in FIG. 3.

Now referring to FIGS. 3 and 4, the final assembly of the clip 10 is performed by simply pressing the upper face beam 36 and lower face beam 12 together engaging the tip 30 with the latching body 50 allowing the upper jaw element 48 and lower jaw element 26 to lock in a closed position. The squeezing together of the opposing jaws 48 and 26 latches them together by means of the hook at the tip 30 of the pivot bar 32 interconnecting and locking the tip 30 into the latch receptacle 50 under the opposite surface 44. This latching also stresses the pivot bar 32 by straightening out its previously arced profile 32 forcing the tip to stay within the correspondingly shaped latch receptacle 50.

Opening the clip 10 is performed by pressing the upper and lower face beams along their proximal end portions 14 and 42 which compresses the traverse support member 34 allowing the upper face beam 36 to pivot on the pivotal means 28. Continued squeezing of the proximal end portions 14 and 42 causes the pivotal means 28 to arc beyond the radiation angle forcing the jaws 26 and 48 into a larger spaced apart position. To prevent stressing the traverse support member 34 beyond its predetermined compression range, fingers 38 are provided to provide interference with complete compression.

Figure 5:
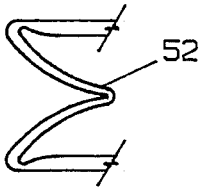
FIG. 5 is a partial side view of a V-shaped traverse support member that may be substituted for the U-shaped traverse support member used in FIGS. 1–4.
Figure 6:
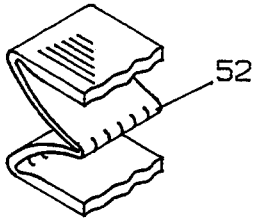
FIG. 6 is a perspective view of the profile shown in FIG. 5.
Figure 7:
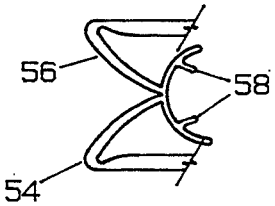
FIG. 7 is a partial side view of a compound primary traverse support member having a V-shape joined to an arc support member.
Figure 8:
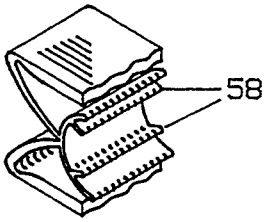
FIG. 8 is a perspective view of FIG. 7.
Figure 9:
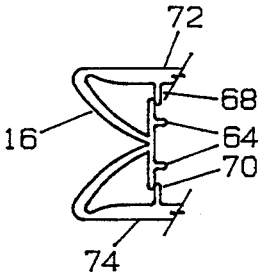
FIG. 9 is a partial side view of a V-shaped traverse support member joined to a vertical support member.
Figure 10:
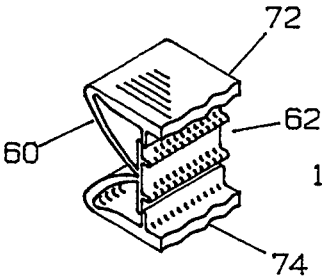
FIG. 10 is a perspective view of FIG. 9.

Referring to FIGS. 5 and 6, a V-shaped traverse support member is shown for substitution of the U-shaped traverse support member shown in FIGS. 1–4. FIGS. 7 and 8 set forth the profile of a compound traverse support member comprising a V-shape 56 joined to an arc 58 which has two fingerlike extensions 58 radiating toward the focus of the arc. It should be noted that this traverse support member can also be substituted for the "V" and "U" shaped primary traverse support members. FIGS. 9 and 10 set forth a V-shaped primary traverse support member 60 joined to a bar traverse support member 62 having two front protruding fingers 64 used to stop compression by engaging tabs 68 and 50 of upper support beam 72 and lower support beam 74 respectively. In use the V-shaped intersection would move to the front stressing the bar traverse support member into an arc. The bar traverse support member is restrained from forward movement by tabs 68 and 70 protruding inward from inside of the upper and lower face-beams.

Figure 11:
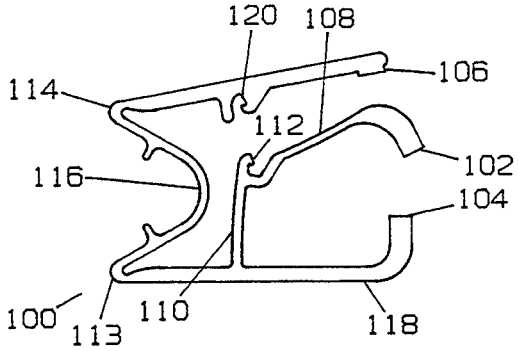
FIG. 11 is side view of a second embodiment of the clip having one set of primary jaws and a secondary jaws.
Figure 12:
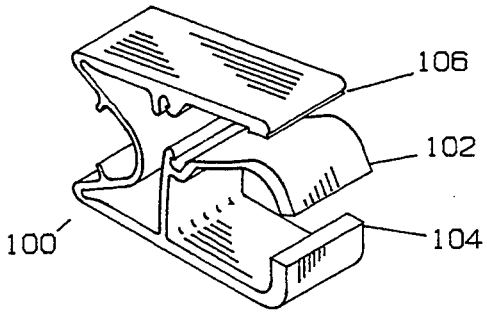
FIG. 12 is a perspective view of FIG. 11.

Referring to FIGS. 11 and 12 is side view of a second embodiment of the clip 100 having a middle jaw 102 and a lower jaw 104. In addition a forward facing secondary jaw 106 is provided. The second embodiment incorporates the primary cross bar 110 having a latching hook 112 on the leeward tip as described with in the first embodiment with the middle jaw 102 operatively associated therewith. The traverse support member 116 communicates to the lower support beam 118 at the lower proximal end 113, and with the upper jaw 106 at proximal end 114.

Figure 13:
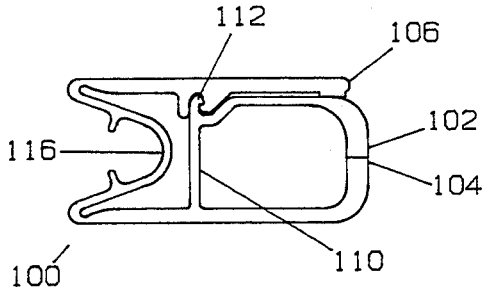
FIG. 13 is a side view of the second embodiment in a closed position.
Figure 14:
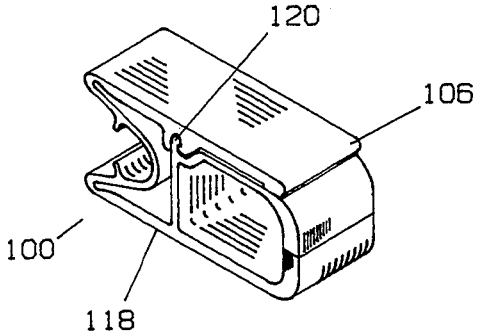
FIG. 14 is a perspective view of FIG. 13.

FIGS. 13 and 14 show the second embodiment in a closed position wherein closure of the clip 100 is performed by pressing the outer surface of upper jaw 106 and lower face beam 118 together engaging tip 112 to a latching body 120 allowing the middle jaw element 102 and lower jaw element 104 to lock in a closed position by the biasing of the traverse support member 116. The squeezing together of the opposing jaws 102 and 104 latches them together by means of the hook at the tip 112 of the pivot bar 110 interconnecting and locking the tip 112 into the latch receptacle 120. Upper jaw element 106 is further pressed against a side surface of the middle jaw arm 108 providing the secondary jaw in a frontal position.

Figure 15:
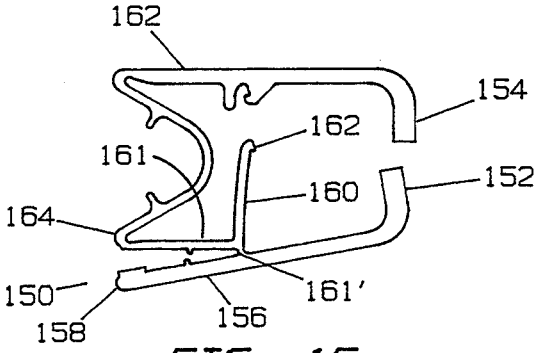
FIG. 15 is side view of a third embodiment of the clip having a rear facing lower secondary jaw and a set of front facing primary jaws.
Figure 16:
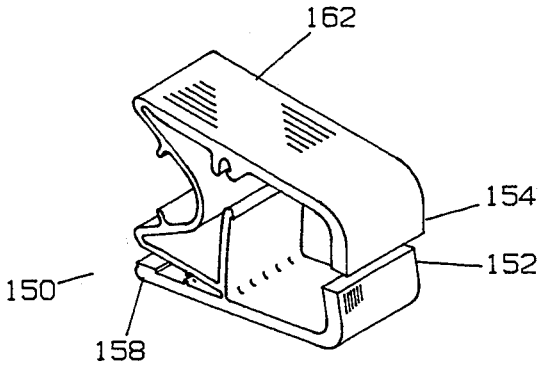
FIG. 16 is a perspective view of FIG. 15.

FIGS. 15 and 16 is a side view of a third embodiment of the clip 150 having a lower primary jaw 152 and upper primary jaw 154. The lower half 158 of the primary jaw 152 is at the same time the upper half of a secondary jaw 156. The embodiment incorporates the primary cross bar 160 having a latching hook 162 with a leeward tip as described in the first embodiment. The proximal end 164 is coupled directly to the cross bar 160. The embodiment provides assembly stresses in a downward position wherein the 23 lower jaw 158 contacts the upper half of the primary jaw. Undercut 161' at the base of bar 161 allows leveraging to take place as a hinge. This undercut is also used in other embodiments described hereinbelow, where it is necessary to allow for more resiliency to the plastic material in order to allow for the pivoting there, and, therefore, will not be described in the figures of those embodiments.

Figure 17:
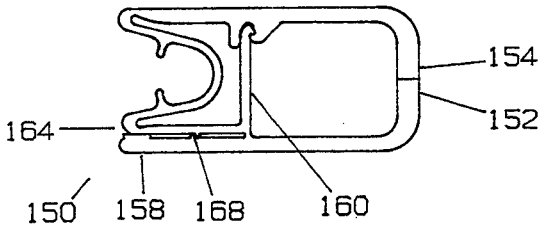
Figure 18:
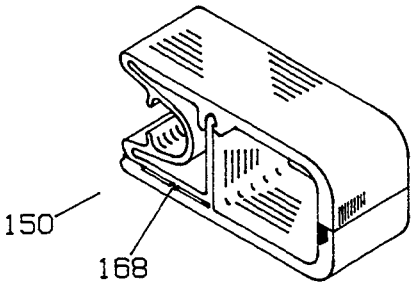
FIG. 18 is a side view of the third embodiment in a closed position.

FIGS. 17 and 18 illustrate the third embodiment in a closed position. Closure of the clip 150 straightens and stresses the primary cross-bar 160 and hinges it from an oblique angle to the surface of the face beam in a right-angle thereto. The primary jaws 152 and 154 are thus locked in a closed position. In addition, the closure loads the secondary jaw's 158 tightly against the proximal end 164 with no energy from any other traverse support member to accomplish the closure. Use of cross projections 168 assist in holding thin materials and limits axial movement and retains interstitial spacing.

Figure 19:
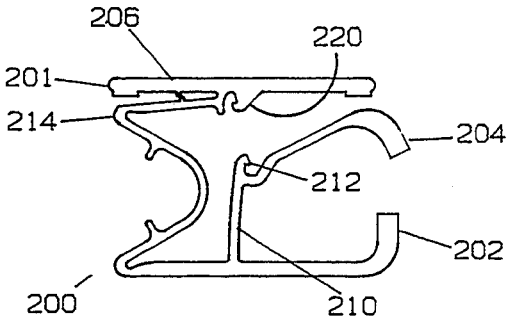
FIG. 19 is a side view of a fourth embodiment of the clip having an upper rear-facing and a front facing secondary jaws set plus a forward facing primary jaw set.
Figure 20:
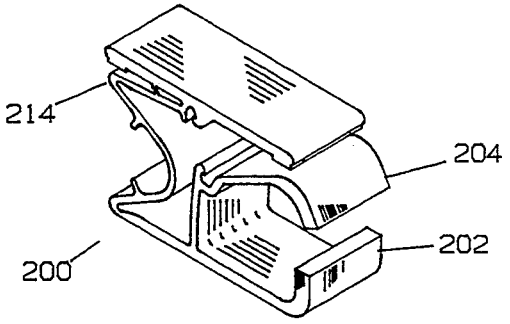
FIG. 20 is a perspective view of FIG. 19.

FIGS. 19 and 20 is a side view of a fourth embodiment which is similar to the third embodiment with attachment to the latching receptacle in place of the pivotal arm. In this embodiment the clip 200 has an upper rear-facing secondary jaw 201 with a lower primary jaw 202 and upper primary jaw 204. The upper half 206 of the primary jaw 202 is at the same time the upper half of primary jaw 204. The embodiment incorporates the primary cross bar 210 having a latching hook 212 with a leeward tip as described with in the first embodiment. The proximal end 214 is coupled directly to the latching receptacle 220.

Figure 21:
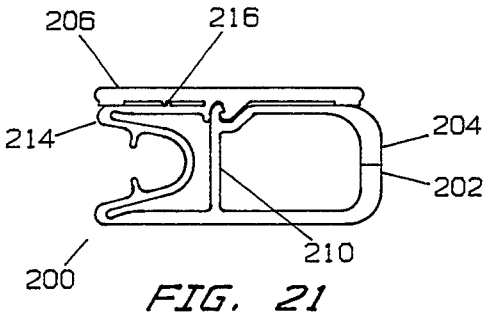
FIG. 21 is a side view of the forth embodiment in a closed position.
Figure 22:
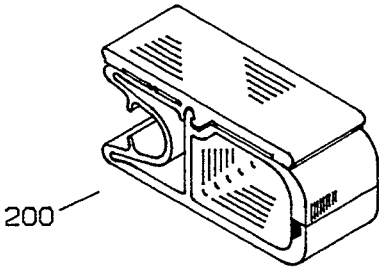
FIG. 22 is a perspective view of FIG. 21.

FIGS. 21 and 22 illustrate the fourth embodiment in a closed position. Closure of the clip 200 straightened and stresses the primary cross-bar 210 and hinges it from an oblique angle to the surface of the face beam into right-angle thereto. The primary jaws 204 and 202 are locked in a closed position. In addition, the closure loads the secondary jaws 201 tightly against the proximal end 214 with no energy from any other traverse support member to accomplish the closure. Use of protrusions 216 assist in holding thin materials, and the use of cross protrusions as described in detail later in this specification, function to retain in parallel the interstices, eliminate most flexation of the secondary traverse support member arms between their origination point and the protrusions and restrict axial movement of the bar traverse support members caused by the latching forces hinging movement.

Figure 23:
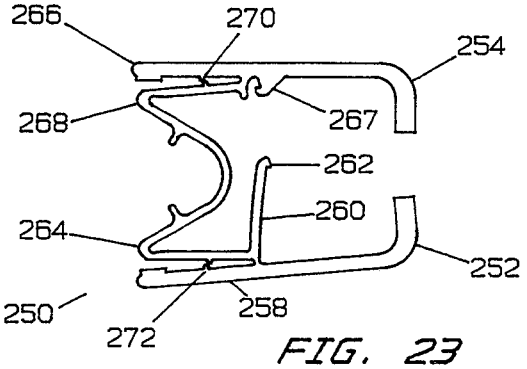
FIG. 23 is a side view of a fifth embodiment of the clip having two rearward facing secondary clip jaws plus a forward facing primary jaw set.
Figure 24:
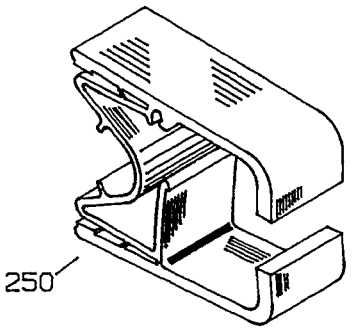
FIG. 24 is a perspective view of FIG. 23.

FIGS. 23 and 24 set forth a fifth embodiment of the clip 250 having two rearward facing secondary clip jaws. The clip 250 has a lower primary jaw 252 and upper primary jaw 254. The lower half 258 of the primary jaw 252 is at the same time the upper half of a secondary jaw 256. The primary cross bar 260 having a latching hook 262 with a leeward tip as described in the first embodiment. The proximal end 264 is coupled directly to the cross bar 260. The embodiment provides assembly stresses in a downward position wherein the lower jaw 258 contacts the upper half of the primary jaw. The lower half 266 of the upper primary jaw 254 is at the same time the upper half of the secondary jaw 266. The secondary jaw 266 is formed into part of latching hook 267.

Figure 25:
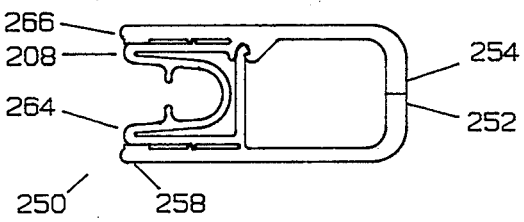
FIG. 25 is a side view of the fifth embodiment in a closed position.
Figure 26:
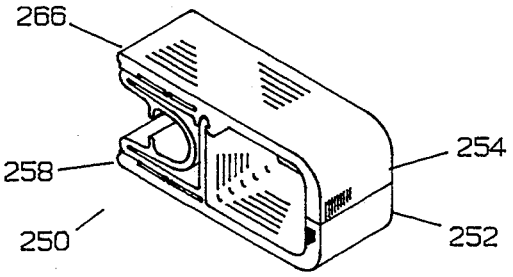
FIG. 26 is a perspective view of FIG. 25.

FIGS. 25 and 26 illustrate the fifth embodiment in a closed position. Closure of the clip 250 straightens and stresses the primary cross-bar 260 locking the hook 262 into latching receptacle 267. The primary jaws 252 and 254 are locked in a closed position. In addition, the closure loads both secondary jaws 258 and 266 tightly against their respective proximal ends 264 and 268 with no energy from any other traverse support member to accomplish the closure. Cross projections 270 and 272 assist in holding thin materials.

Figure 27:
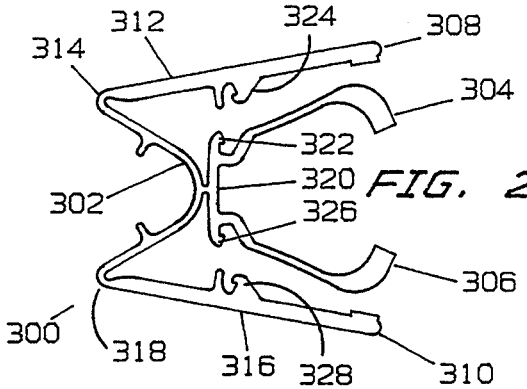
FIG. 27 is a side view of the sixth embodiment wherein a U-shaped traverse support member-clip has two front facing secondary jaws, one primary jaw set, and two latching receptacles.
Figure 28:
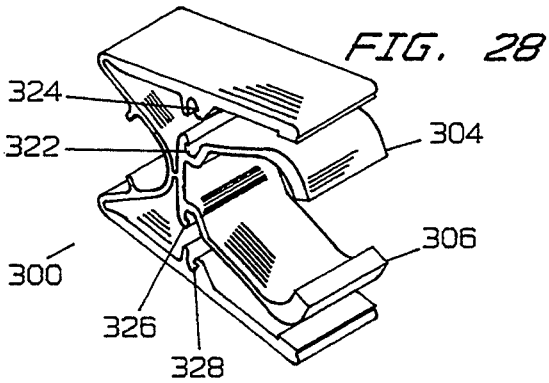
FIG. 28 is a perspective view of FIG. 27.

FIGS. 27 and 28 set forth a sixth embodiment 300 wherein the traverse support member 302 is U-shaped and is directly coupled to a primary jaw set defined by an upper jaw 304 and a lower jaw 306. Secondary jaws are defined by an upper secondary jaw 308 and a lower secondary jaw 310. The upper secondary jaw 308 is set at the distal end of the upper face beam 312 whose proximal end 314 forms a portion of the U-shaped traverse support member 302. Similarly, the lower secondary jaw 310 is set at the distal end of the lower face beam 316 whose proximal end 318 forms a remaining portion of the U-shaped traverse support member 302. Unique to this embodiment is the use of primary cross bar 320 having an upper locking tip end 322 for latching into latching receptacle 324 located on the inner surface of upper face beam 312 and a lower locking tip end 326 for latching into latching receptacle 328 located on the inner surface of lower face beam 316.

Figure 29:
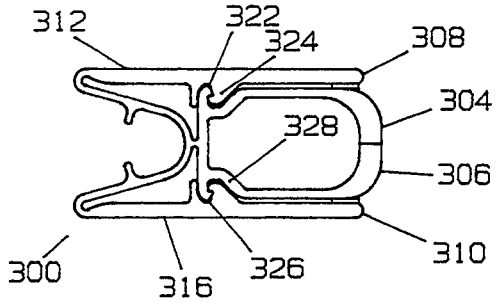
FIG. 29 is a side view of the sixth embodiment in a closed position.
Figure 30:
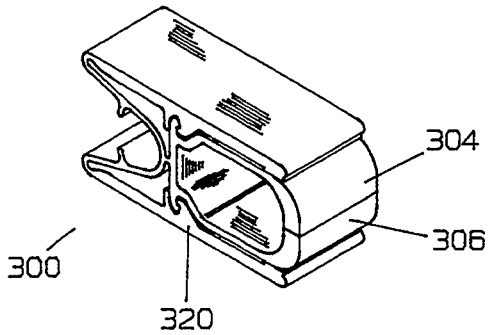
FIG. 30 is a perspective view of FIG. 29.

FIGS. 29 and 30 shows the sixth embodiment in a closed position. Closure of the clip 300 is performed by squeezing the upper and lower face beams 312 and 316 allowing locking tip ends 322 and 326 insertion into latching receptacles 324 and 328 respectively. The locking of the tips places both the primary and secondary jaws into a closed position. During the squeezing of the clip 300 to open the jaws, the U-shaped primary traverse support member 320 tends to move its arc forward towards the clip front. The "U" is attached at its arc to the primary cross-bar traverse support member. This attachment retains all parts and the forward movement and, after closure, further stresses the cross-bar traverse support member 320 to increases the primary jaws clamping force.

Figure 31:
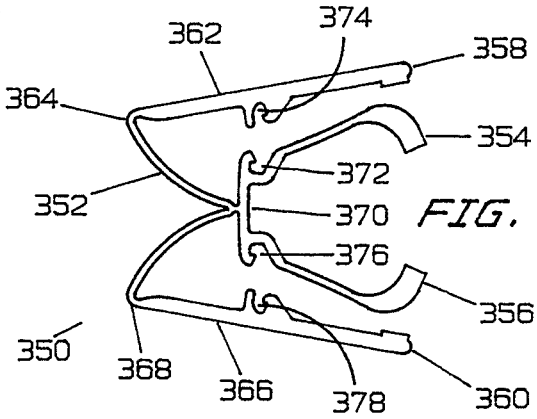
FIG. 31 is a side view of the seventh embodiment wherein a V-shaped traverse support member-clip has two front facing secondary jaws, one primary jaw set and two latching receptacles.
Figure 32:
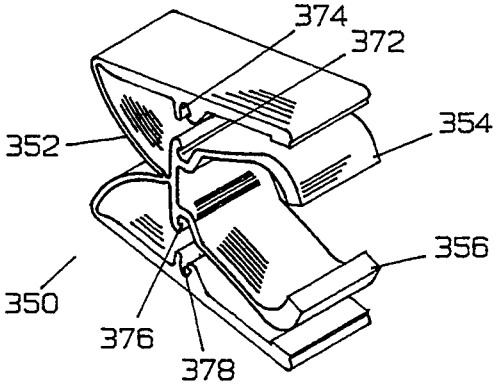
FIG. 32 is a perspective view of FIG. 31.

FIGS. 31 and 32 set forth a seventh embodiment 350 wherein the traverse support member 352 is V-shaped and is directly coupled to an upright traverse member 370 and a primary jaw set defined by an upper jaw 354 and a lower jaw 356. Secondary jaws are defined by an upper secondary jaw 358 and a lower secondary jaw 360. The upper secondary jaw 358 is set at the distal end of the upper face beam 362 whose proximal end 364 forms a portion of the V-shaped traverse support member 352. Similarly, the lower secondary jaw 360 is set at the distal end of the lower face beam 366 whose proximal end 368 forms a remaining portion of the V-shaped traverse support member 352. Similar to the sixth embodiment, the primary cross bar 370 having an upper locking tip end 372 for latching into latching receptacle 374 located on the inner surface of upper face beam 362 and a lower locking tip end 376 for latching into latching receptacle 378 located on the inner surface of lower face beam 366.

Figure 33:
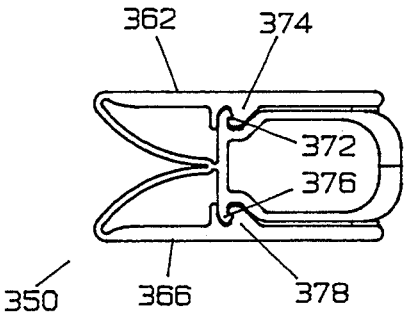
FIG. 33 is a side view of the seventh embodiment in a closed position.
Figure 34:
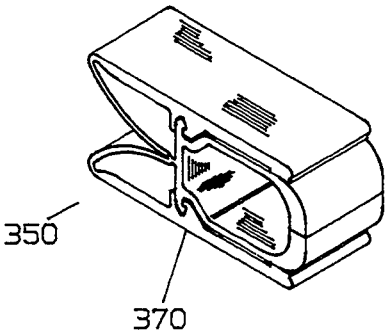
FIG. 34 is a perspective view of FIG. 33.

FIGS. 33 and 34 shows the seventh embodiment in a closed position. Closure of the clip 350 is performed by squeezing the upper and lower face beams 362 and 366 allowing locking tip ends 372 and 376 insertion into latching receptacles 374 and 378 respectively. The locking of the tips places both the primary and secondary jaws into a closed position. During the squeezing of the clip 350 to open the jaws, the V-shaped primary traverse support member 370 tends to move its arc forward towards the clip front. The "V" is attached at its arc to the primary cross-bar traverse support member. This attachment retains all parts and the forward movement and, after closure, further stresses the cross-bar traverse support member 370 to increases the primary jaws clamping force.

FIGS. 35 and 36 set forth a eighth embodiment 400 wherein the traverse support member 402 is V-shaped design which forms a stirrup-shaped retainer upon closure. The member 402 is directly coupled to a primary jaw set defined by an upper jaw 404 and a lower jaw 406. Secondary jaws are defined by an upper secondary jaw 408 and a lower secondary jaw 410. The upper secondary jaw 408 is set at the distal end of the upper face beam 412 whose proximal end 414 forms a portion of the V-shaped traverse support member 402. Similarly, the lower secondary jaw 410 is set at the distal end of the lower face beam 416 whose proximal end 318 forms a remaining portion of the V-shaped traverse support member 402. This embodiment uses the primary cross bar 420 having an upper locking tip end 422 for latching into latching receptacle 424 located on the inner surface of upper face beam 412 and a lower locking tip end 426 for locking into latching receptacle 428 located on the inner surface of lower face beam 416.

FIGS. 37 and 38 shows the eighth embodiment in a closed position. Closure of the clip 400 is performed by squeezing the upper and lower face beams 412 and 416 allowing locking tip ends 422 and 426 insertion into latching receptacles 424 and 428 respectively. The locking of the tips places both the primary and secondary jaws into a closed position. During the squeezing of the clip 400 to open the jaws, the V-shaped primary traverse support member 420 tends to move its arc forward towards the clip front. The "V" is attached jointly at its arc to the primary cross-bar traverse support member as in the previous embodiments but rather spaced apart so as to create the stirrup cavity 430 for placement around cylindrical shafts.

FIGS. 39 and 40 set forth a ninth embodiment 450 wherein a combination V-shape and plumber's force-cup profile creates a compound primary traverse support member 452, which is directly coupled to a primary jaw set defined by an upper jaw 454 and a lower jaw 456. Secondary jaws are defined by an upper secondary jaw 458 and a lower secondary jaw 460. The upper secondary jaw 458 is set at the distal end of the upper face beam 462 whose proximal end 464 forms a portion of the V-shaped traverse support member 452. Similarly, the lower secondary jaw 460 is set at the distal end of the lower face beam 366 whose proximal end 468 forms a remaining portion of the V-shaped traverse support member 452. Similar to the sixth embodiment, the primary cross bar 470 having an upper locking tip end 472 for latching into latching receptacle 474 located on the inner surface of upper face beam 462 and a lower locking tip end 476 for latching into latching receptacle 478 located on the inner surface of lower face beam 466.

FIGS. 41 and 42 shows the ninth embodiment in a closed position. Closure of the clip 450 is performed by squeezing the upper and lower face beams 462 and 466 allowing locking tip ends 472 and 476 insertion into latching receptacles 474 and 478 respectively. The locking of the tips places both the primary and secondary jaws into a closed position. During the squeezing of the clip 450 to open the jaws, the V-shaped primary traverse support member 470 tends to move the outer portions of its arc forward towards the clip front. The "V" is attached at its arc to the primary cross-bar traverse support member. This attachment retains all parts and the forward movement and, after closure, further stresses the cross-bar traverse support member 470 to increases the primary jaws clamping force.

FIGS. 43 and 44 is side view of an tenth embodiment of the clip 500 having the combined benefits of the second and fourth embodiments as depicted in FIGS. 11–14 and FIGS. 19–22. The instant embodiment includes a middle jaw 502 and a lower jaw 504. A first secondary jaw 506 is provided wherein the one-half of the primary lower jaw 504 is at the same time the one half of the secondary jaw 506. The embodiment incorporates the primary cross bar 510 having a latching hook 512 with a leeward tip, as described with in the first embodiment, with the middle jaw 502 incorporated therein. The proximal end 514 forms a portion of the traverse support member 521 biasing the lower face beam 516 with an upper face beam 522. The upper face beam 522 having an upper primary jaw 524 located at the distal end and a second secondary jaw 526 disposed at the distal end of said beam 522.

FIGS. 45 and 46 show the tenth embodiment in a closed position wherein closure of the clip 500 is performed by pressing the upper face beam 522 and lower face beam 516 together engaging the tip 512 with the latching body 520 allowing the middle jaw element 502 and lower jaw element 504 to lock in a closed position by the biasing of the traverse support member 521. Upper jaw element 524 is further pressed into a closure position against the upper surface of middle jaw element 502. Simultaneously both secondary jaw members 526 and 506 are pressed against their respective proximal end points allowing the embodiment to have a five jaws for attachment. In addition, the use of the U-shaped traverse support member 521 allows for the cavity for placement of a cylindrical attachment device.

Referring to FIGS. 47 and 48, a "V" shaped traverse support member 536 is shown for substitution of the U-shaped traverse support member shown in FIGS. 11–28. FIGS. 49 and 50 set forth the profile of a compound traverse support member comprising a V-shape 538 joined to an arc 540 which has two finger-like extensions 542 radiating toward the focus of the arc. It should be noted that this traverse support member can also be substituted for the "V" and "U" shaped primary traverse support members.

FIG. 51 illustrate an extrusion type stress relieving two sided pocket 546 allowing the mating of upper jaw member 548 and lower jaw member 550. The depth of the pocket determines the amount of stress relieved and also reduces the dimension of the jaws opening.

FIG. 52 sets forth an injection molded, four sided, stress relieving pocket 552 which allows the item to be held to bridge across the pocket opening when the jaws are in the closed position.

FIG. 53 is an exploded partial view of the protrusions 560 found within the secondary jaw elements. The protrusions function to retain in parallel the interstices, eliminate most flexation of the secondary traverse support member arms between their origination point and the protrusions and restrict axial movement of the bar traverse support members caused by the latching forces hinging movement.

FIG. 54 is an exploded partial view of the locking tip 562 and latching body 564 found as a basis in each embodiment of this invention. The locking tip 562 includes a leeward hook face 566 engagable with a reverse hook face 568 found on the latching body 564.

FIGS. 55 and 56 set forth an eleventh embodiment 600 wherein the traverse support member 602 is U-shaped and directly coupled to a primary jaw set defined by an upper jaw 604 and a lower jaw 606. Front facing secondary jaws are defined by an upper secondary jaw 608 and a lower secondary jaw 610. The upper secondary jaw 608 is set at the distal end of the upper face beam 612 whose proximal end 614 forms a rear facing secondary jaw. Similarly, the lower secondary jaw 610 is set at the distal end of the lower face beam 616 whose proximal end 618 forms the lower portion of the rear facing secondary jaw. Unique to this embodiment is the use of primary cross bar 620 having an upper locking tip end 622 for latching into latching receptacle 624 located on the inner surface of upper face beam 612 and a lower locking tip end 626 for latching into latching receptacle 628 located on the inner surface of lower face beam 616. The latching receptacle 624 forms a first portion of the traverse support member 602 allowing a corner section 630 to serve as the shoulder for secondary jaw 614. Similarly, latching receptacle 628 forms a second portion of the traverse support member 602 allowing a corner section 6320 to serve as the shoulder for secondary jaw 618.

FIGS. 57 and 58 shows the eleventh embodiment in a closed position. Closure of the clip 600 is performed by squeezing the upper and lower face beams 612 and 616 allowing locking tip ends 612 and 616 allowing insertion of locking tips 622 and 626 into latching receptacles 624 and 628 respectively. The locking of the tips places the primary and both sets of secondary jaws into a closed position.

Now referring to FIGS. 59 and 60, shown is the traverse support member locking mechanism consisting of first toothed arm 650 engagable with lock tooth 652 positioned on the end of a proximal end 654 and a second toothed forming a mirror image thereto.

FIGS. 61 through 63 illustrate the clip member in a locked position with first toothed arm 650 engaging lock tooth 652. The two ratchet toothed arms which upon the clips assembly engage appropriate teeth projecting rearward from each face beam's end. Upon assembly the stressing of the "U" shaped traverse support member 658 swings the two arms 650 and 654 to form a right angle to the face beams 660 and 662 engaging the teeth on the arms into the tooth at each end of the face beams.

FIGS. 64 through 66 illustrates a button hole attachment 700 that can be formed on the proximal end 702 on a basic clip 704. FIGS. 67 and 68 illustrate a slotted button hole 710 attachment that can be formed on the basic clip 712. FIGS. 69 and 70 illustrate an elongated button hole 720 attachment that can be formed on a basic clip 722. FIGS. 71 through 73 illustrates a button hole 730 attachment that can be formed on a rear facing secondary jaw 732 of a clip 754. FIGS. 74 and 75 illustrate a slotted button hole 740 attachment that can be formed on a rear facing secondary jaw 742 of a clip 744. FIGS. 76 and 77 illustrate an elongated button hole 750 attachment that can be formed on a rear facing secondary jaw 752 of a clip 754.

Figure 78:
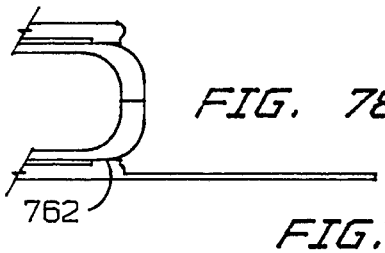
FIG. 78 is a side view of button hole attachment that can be formed on a front facing secondary jaw of a clip.
Figure 79:
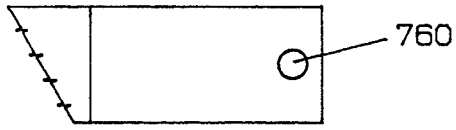
FIG. 79 is a top view of FIG. 78.
Figure 80:
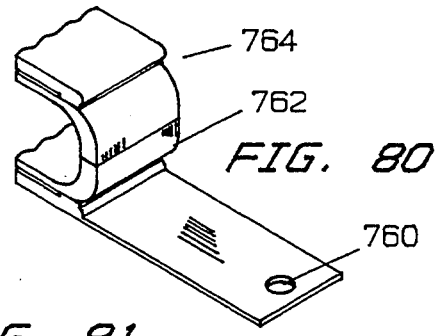
FIG. 80 is a perspective view of FIG. 78.
Figure 81:
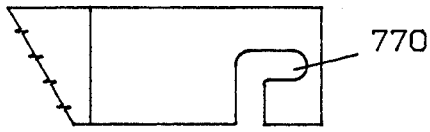
FIG. 81 is a top view of a slotted button hole attachment that can be formed on a front facing secondary jaw of a clip.
Figure 82:
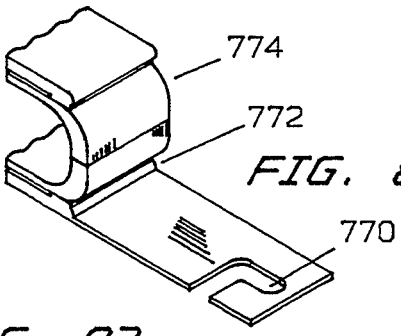
FIG. 82 is a perspective view of FIG. 81.
Figure 83:
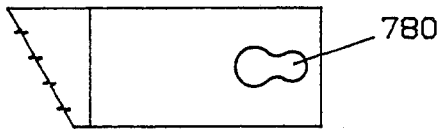
FIG. 83 is a top view of a elongated button hole attachment that can be formed on a rear facing secondary jaw of clip.
Figure 84:
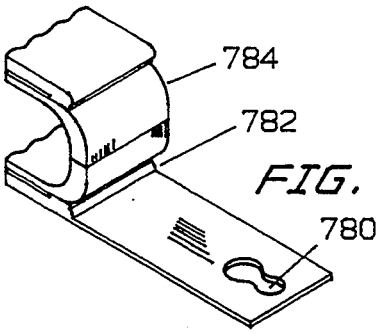
FIG. 84 is a perspective view of FIG. 83.
Figure 85:
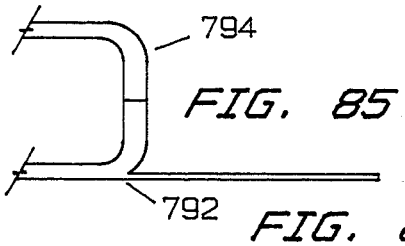
FIG. 85 is a side view of button hole attachment that can be formed on the primary jaw of a basic clip.
Figure 86:
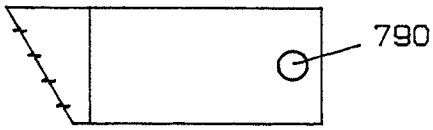
FIG. 86 is a top view of FIG. 85.
Figure 87:
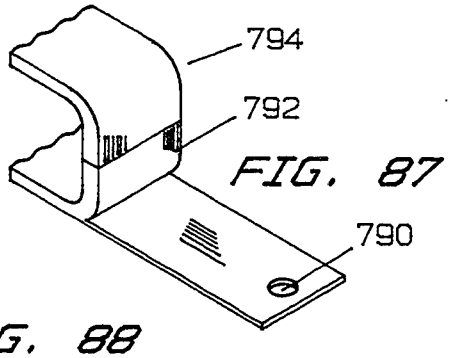
FIG. 87 is a perspective view of FIG. 86.
Figure 88:
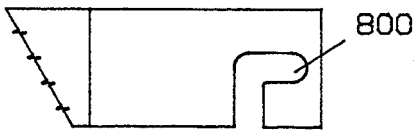
FIG. 88 is a top view of a slotted button hole attachment that can be formed on the primary jaw of a basic clip.
Figure 89:
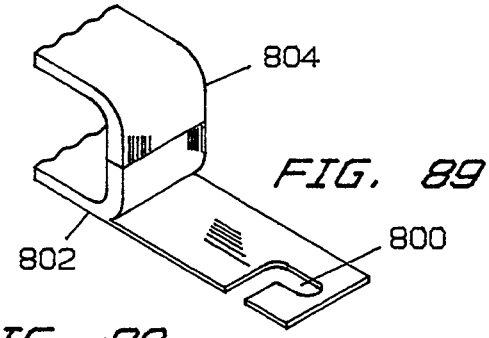
FIG. 89 is a perspective view of FIG. 88.
Figure 90:
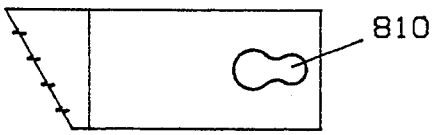
FIG. 90 is a top view of a elongated button hole attachment that can be formed on the primary jaw of a basic clip.
Figure 91:
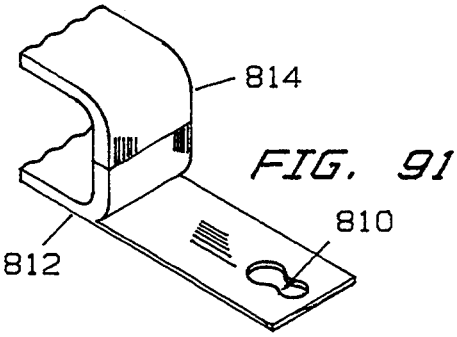
FIG. 91 is a perspective view of FIG. 90.

FIGS. 78 through 80 illustrates a button hole 760 attachment that can be formed on a front facing secondary jaw 762 of a clip 764. FIGS. 81 and 82 illustrate a slotted button hole 770 attachment that can be formed on a rear facing secondary jaw 772 of a clip 774. FIGS. 83 and 84 illustrate an elongated button hole 780 attachment that can be formed on a rear facing secondary jaw 782 of a clip 784. FIGS. 85 through 87 illustrates a button hole attachment 790 that can be formed on the distal end 792 on a basic clip 794. FIGS. 88 and 89 illustrate a slotted button hole 800 attachment that can be formed on the front jaw 802 of a basic clip 804. FIGS. 90 and 91 illustrate an elongated button hole 810 attachment that can be formed on the front jaw 812 of a basic clip 814.

Figure 92:
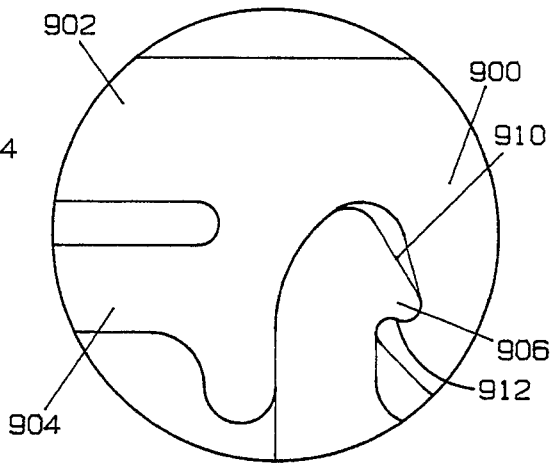
FIG. 92 is an exploded partial view of the locking tip and latching body and means to bias the spring-arm of a rear facing secondary jaws.

FIG. 92 sets forth the latching section 900 having a rear facing secondary jaw 902 formed from a portion of the section together with the traverse support member depending therefrom. The locking tip 906 fits securely within the section 900 using a tapered top 910 and hooked shaped bottom 912.

Figure 93:
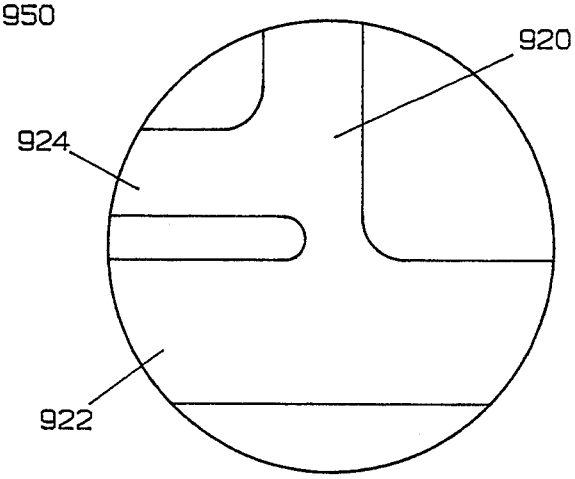
FIG. 93 is an exploded partial view of the secondary rear facing jaw attachment and a means to bias a lower rear facing secondary jaws.

FIG. 93 sets forth the pivotal arm 920 which is directly connect to the rear facing secondary jaw 922 and traverse support member 924.

Figure 94:
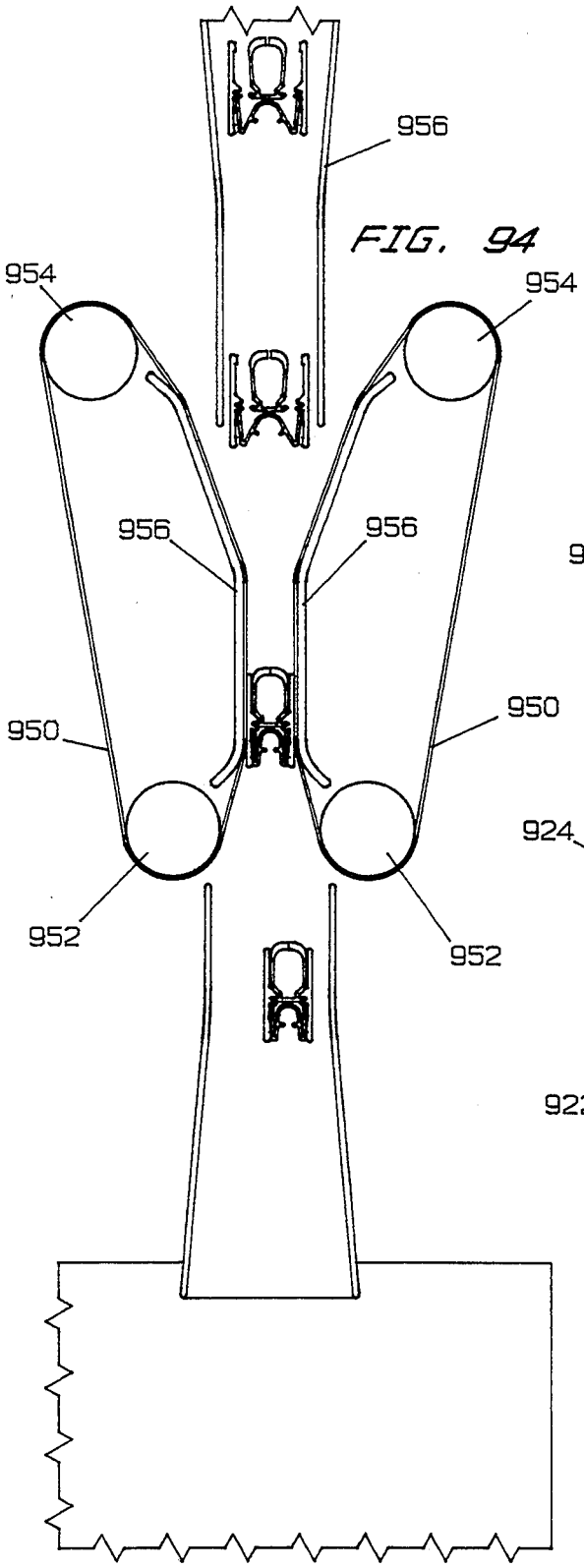
FIG. 94 is a pictorial view of a clip assembly machine.

FIG. 94 is a pictorial of a machine that provides assembly for shipment of the clips in a closed position. This facilitates shipment by allowing the clips to take less room in packaging and prevents the entanglement of jaws. The machine utilizes two belts 950 each connected to a drive 952 and idler pulley 954 and having a common and constant drive rate which move across fixed, ever narrowing platens 956, which squeezes the traverse support member-clips together and assembles them. The device is fed by a downward through an inclined vibratory-acting feed-trough 956 for assemble.

FIGS. 95 through 98 illustrate a clip 1500 with a U-shaped traverse support member 1502 for use with a rear secondary traverse support member 1504 paralleling a substrate surface 1506. Coupling of the secondary support member 1504 to the substrate 1506 is performed by a single barbed tip 1508 which joins with the single barbed tip 1510 of the primary cross-bar traverse support member 1512 to penetrate and latch open on the other side of the pre-punched substrate 1506, thereby stressing all traverse support members and locking the assembly 1500 to the substrate 1506. The stiffening horizontal finger 1514 projecting from the lower end of the primary cross-bar traverse support member transfers stress from the pre-punched hole to the primary cross-bar support member 1512. In addition, the finger 1514 aids in mating the two barbed components 1508 and 1510 for insertion assembly and it also spreads the stress forces that otherwise would be concentrated at the substrate punch-hole. The primary jaw 1516 can be inserted into a second pre-punched hole 1518. Two bulbous ridges 1520 running along both sides of the primary jaw 1516 allow the clip to project a predetermined distance through the substrate hole 1518 as a stress relieving feature.

FIGS. 99 and 102 illustrate a clip 1550 with a V-shaped traverse support member 1552 for use with a rear secondary traverse support member 1554 paralleling a substrate surface 1556. Coupling of the secondary support member 1554 to the substrate 1556 is performed by a single barbed tip 1558 which joins with the single barbed tip 1560 of the primary cross-bar traverse support member 1562 to penetrate and latch open on the other side of the pre-punched substrate 1556, thereby stressing all traverse support members and locking the assembly 1550 to the substrate 1556. The stiffening horizontal finger 1564 projecting from the lower end of the primary cross-bar traverse support member transfers stress from the pre-punched hole to the primary cross-bar support member 1562. In addition, the finger 1564 aids in mating the two barbed components 1558 and 1560 for insertion assembly and it also spreads the stress forces that otherwise would be concentrated at the substrate punch-hole. The primary jaw 1566 can be inserted into a second pre-punched hole 1568. Two bulbous ridges 1570 running along both sides of the primary jaw 1556 allow the clip to project a predetermined distance through the substrate hole 1568. The upper beam 1580 includes a rear facing secondary jaw 1582 allowing jaw facing in both directions.

FIGS. 105 and 106 illustrate a clip 1600 with a V-shaped traverse support member 1602 for use with a rear secondary traverse support member 1604 paralleling a substrate surface 1606. Coupling of the secondary support member 1604 to the substrate 1606 is performed by a single barbed tip 1608 which joins with the single barbed tip 1610 of the primary cross-bar traverse support member 1612 to penetrate and latch open on the other side of the pre-punched substrate 1606, thereby stressing all traverse support members and locking the assembly 1600 to the substrate 1606. The stiffening horizontal finger 1614 projecting from the lower end of the primary cross-bar traverse support member transfers stress from the pre-punched hole to the primary cross-bar support member 1612. In addition, the finger 1614 aids in mating the two barbed components 1608 and 1610 for insertion assembly and it also spreads the stress forces that otherwise would be concentrated at the substrate punch-hole. The primary jaw 1616 can be inserted into a second pre-punched hole 1618. Two bulbous ridges 1620 running along both sides of the primary jaw 1616 allow the clip to project a predetermined distance through the substrate hole 1618. The upper beam 1620 includes a rear facing secondary jaw 1622 for abutment to the upper side of the V-shaped traverse support member 1602. In addition, the lower side of the V-shaped traverse support member 1602 incorporates a shoulder 1624 providing a second rear facing jaw for clamping against the substrate 1606.

FIGS. 107 and 108 illustrate a clip 1000 with a V-shaped traverse support member 1002 for use with a rear secondary traverse support member 1004 paralleling a substrate surface 1006. Coupling of the secondary support member 1004 to the substrate 1006 is performed by a single barbed tip 1008 which joins with the single barbed tip 1010 of the primary cross-bar traverse support member 1012 to penetrate and latch open on the other side of the pre-punched substrate 1006, thereby stressing all traverse support members and locking the assembly 1000 to the substrate 1006. The stiffening horizontal finger 1014 projecting from the lower end of the primary cross-bar traverse support member transfers stress from the pre-punched hole to the primary cross-bar support member 1012. In addition, the finger 1014 aids in mating the two barbed components 1008 and 1010 for insertion assembly and it also spreads the stress forces that otherwise would be concentrated at the substrate punch-hole. The primary jaw 1016 can be inserted into a second pre-punched hole 1018. Two bulbous ridges 1020 running along both sides of the primary jaw 1016 allow the clip to project a predetermined distance through the substrate hole 1018.

FIGS. 109 and 110 illustrate a clip 1050 with a V-shaped traverse support member 1052 for use with a rear secondary traverse support member 1054 paralleling a substrate surface 1056. Coupling of the secondary support member 1054 to the substrate 1056 is performed by a single barbed tip 1058 which joins with the single barbed tip 1060 of the primary cross-bar traverse support member 1062 to penetrate and latch open on the other side of the pre-punched substrate 1056, thereby stressing all traverse support members and locking the assembly 1050 to the substrate 1056. The stiffening horizontal finger 1064 projecting from the lower end of the primary cross-bar traverse support member transfers stress from the pre-punched hole to the primary cross-bar support member 1062. In addition, the finger 1064 aids in mating the two barbed components 1058 and 1060 for insertion assembly and it also spreads the stress forces that otherwise would be concentrated at the substrate punch-hole. The primary jaw 1066 can be inserted into a second pre-punched hole 1068. Two bulbous ridges 1070 running along both sides of the primary jaw 1056 allow the clip to project a predetermined distance through the substrate hole 1068. The upper beam 1080 includes a rear facing secondary jaw 1082 allowing jaw facing in both directions.

FIGS. 111 and 112 illustrate a clip 1100 with a V-shaped traverse support member 1102 for use with a rear secondary traverse support member 1104 paralleling a substrate surface 1106. Coupling of the secondary support member 1104 to the substrate 1106 is performed by a single barbed tip 1108 which joins with the single barbed tip 1110 of the primary cross-bar traverse support member 1112 to penetrate and latch open on the other side of the pre-punched substrate 1106, thereby stressing all traverse support members and locking the assembly 1100 to the substrate 1106. The stiffening horizontal finger 1114 projecting from the lower end of the primary cross-bar traverse support member transfers stress from the pre-punched hole to the primary cross-bar support member 1112. In addition, the finger 1114 aids in mating the two barbed components 1108 and 1110 for insertion assembly and it also spreads the stress forces that otherwise would be concentrated at the substrate punch-hole. The primary jaw 1116 can be inserted into a second pre-punched hole 1118. Two bulbous ridges 1120 running along both sides of the primary jaw 1116 allow the clip to project a predetermined distance through the substrate hole 1118. The upper beam 1120 includes a rear facing secondary jaw 1122 for abutment to the upper side of the V-shaped traverse support member 1102. In addition, the lower side of the V-shaped traverse support member 1102 incorporates a shoulder 1124 providing a second rear facing jaw for clamping against the substrate 1106.

FIGS. 113 and 114 illustrate a clip 1200 with a V-shaped traverse support member 1202 connected to an upright compression plate 1203 for use with a rear secondary traverse support member 1204 paralleling a substrate surface 1206. Coupling of the secondary support member 1204 to the substrate 1206 is performed by a single barbed tip 1208 which joins with the single barbed tip 1210 of the primary cross-bar traverse support member 1212 to penetrate and latch open on the other side of the pre-punched substrate 1206, thereby stressing all traverse support members and locking the assembly 1200 to the substrate 1206. The stiffening horizontal finger 1214 projecting from the lower end of the primary cross-bar traverse support member transfers stress from the pre-punched hole to the primary cross-bar support member 1212. In addition, the finger 1214 aids in mating the two barbed components 1208 and 1210 for insertion assembly and it also spreads the stress forces that otherwise would be concentrated at the substrate punch-hole. The primary jaw 1216 can be inserted into a second pre-punched hole 1218. Two bulbous ridges 1220 running along both sides of the primary jaw 1216 allow the clip to project a predetermined distance through the substrate hole 1218.

FIGS. 115 and 116 illustrate a clip 1250 with a V-shaped traverse support member 1252 connected to an upright compression plate 1253 for use with a rear secondary traverse support member 1254 paralleling a substrate surface 1256. Coupling of the secondary support member 1254 to the substrate 1256 is performed by a single barbed tip 1258 which joins with the single barbed tip 1260 of the primary cross-bar traverse support member 1262 to penetrate and latch open on the other side of the pre-punched substrate 1256, thereby stressing all traverse support members and locking the assembly 1250 to the substrate 1256. The stiffening horizontal finger 1264 projecting from the lower end of the primary cross-bar traverse support member transfers stress from the pre-punched hole to the primary cross-bar support member 1262. In addition, the finger 1264 aids in mating the two barbed components 1258 and 1260 for insertion assembly and it also spreads the stress forces that otherwise would be concentrated at the substrate punch-hole. The primary jaw 1266 can be inserted into a second pre-punched hole 1268. Two bulbous ridges 1270 running along both sides of the primary jaw 1256 allow the clip to project a predetermined distance through the substrate hole 1268. The upper beam 1280 includes a rear facing secondary jaw 1282 allowing jaw facing in both directions.

FIGS. 117 and 118 illustrate a clip 1300 with a V-shaped traverse support member 1302 connected to an upright compression plate 1303 for use with a rear secondary traverse support member 1304 paralleling a substrate surface 1306. Coupling of the secondary support member 1304 to the substrate 1306 is performed by a single barbed tip 1308 which joins with the single barbed tip 1310 of the primary cross-bar traverse support member 1112 to penetrate and latch open on the other side of the pre-punched substrate 1306, thereby stressing all traverse support members and locking the assembly 1300 to the substrate 1306. The stiffening horizontal finger 1314 projecting from the lower end of the primary cross-bar traverse support member transfers stress from the pre-punched hole to the primary cross-bar support member 1312. In addition, the finger 1314 aids in mating the two barbed components 1308 and 1310 for insertion assembly and it also spreads the stress forces that otherwise would be concentrated at the substrate punch-hole. The primary jaw 1316 can be inserted into a second pre-punched hole 1318. Two bulbous ridges 1320 running along both sides of the primary jaw 1316 allow the clip to project a predetermined distance through the substrate hole 1318. The upper beam 1320 includes a rear facing secondary jaw 1322 for abutment to the upper side of the V-shaped traverse support member 1302. In addition, the lower side of the V-shaped traverse support member 1302 incorporates a shoulder 1324 providing a second rear facing jaw for clamping against the substrate 1306.

FIGS. 119–123 illustrate a clothes hanger 1650 having flat substrates 1652 for attachment of a half clip 1654. Placement of the half clip 1654 allows the jaws 1656 to face in a downward position. As previously mentioned, coupling of the secondary support member to the single barbed tip which joins with the single barbed tip of the primary cross-bar traverse support member to penetrate and latch open on the other side of the pre-punched 1660 slot of substrate 1658. The primary jaw 1656 can be inserted into a second pre-punched hole 1662. Alternatively, as shown in FIG. 121, the primary jaw 1670 can be biased against a substrate 1672 having a single slot 1674 for the barbed tip 1676 of the cross bar only. FIG. 122 shows a single rathcet-tooth for securing to the hanger.

FIGS. 123 through 128 set forth a badge embodiment 1700 of the instant invention wherein the upper face beam 1702 and lower face beam 1704 contains an enlarged area 1706 and 1708 for placement of indicia. The rear facing jaw 1710 is available for attachment of the clothing of a wearer to. The front primary jaws 1712 and the front secondary jaw 1702 are available for attaching of the badge 1714. Since only one of the jaws are in use, the remaining jaw is free for holding of additional badges, tags and so forth.

Figure 130:
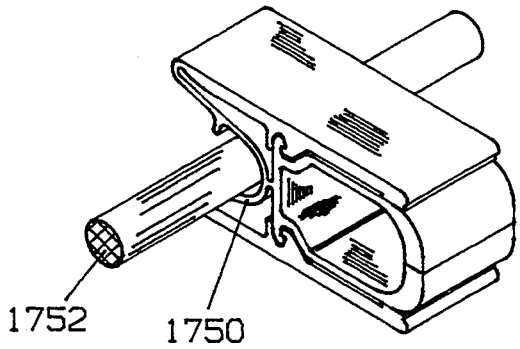
Figure 131:
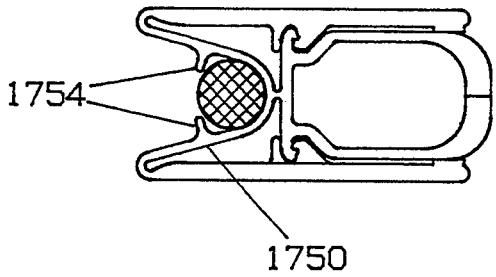
Figure 132:
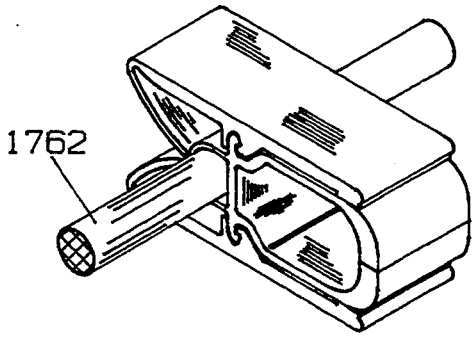
Figure 133:
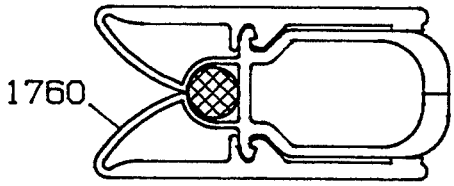

Now referring to FIGS. 130 through 137, shown are the various traverse support member embodiments in their attachment to shaft. FIGS. 130 and 131 set forth the U-shaped traverse support member 1750 for holding of the shaft 1752. The protruding fingers 1754 are shown in their ability to grip the shaft. FIGS. 132 and 133 set forth the V-shaped traverse support member with saddle 1760 for holding of the shaft 1762. FIGS. 134 and 135 set forth the V-shaped traverse support member with a complex saddle 1770 for holding of the shaft 1772 by means of forming an aperture 1774 for insertion of the shaft 1772. FIGS. 136 and 137 set forth the upstanding traverse support member 1780 for holding of the shaft 1782 by means of forming an aperture 1784 for insertion of the shaft 1782. The versions shown in FIGS. 131 and 137 can be assembled around open-ended or closed-ended shafting, while those of FIGS. 133 and 135 can only be attached where the shafting is open at one or both ends.

It is to be understood that while I have illustrated and described certain forms of my invention, it is not to be limited to the specific forms or engagement of parts herein describe and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A one piece clip comprising: a lower face beam defined by proximal and distal end portions, side edges and inner and outer side surfaces; a first distal end portion having a substantially right angled lower jaw element extending upwardly from said inner surface of said lower face beam and a pivotal means extending upwardly from the inner surface of said lower face beam to a second distal end portion having a substantially right angled middle jaw element extending downwardly toward said lower jaw element; said proximal end forming a first half portion of a traverse support member biasing said lower face beam with an upper face beam; said upper face beam defined by proximal and third distal end portion, side edges and inner and outer side surfaces; said third distal end portion of said upper face beam forming an upper jaw element extending downwardly from said inner surface of said upper face beam and a locking means engageable with said pivotal means; said proximal end forming a second half portion of said traverse support member biasing said upper face beam to said lower face beam; whereby the pressing of the upper and lower face beams together engages said means for pivoting with said locking means causing said upper jaw element to close against a back side of said middle jaw element and said middle jaw element closing against said lower jaw elements to lock said elements in a closed position by the biasing of said traverse support member, wherein the pressing of the upper and lower face beams along their proximal end portions compresses said traverse support member allowing said upper face beam to pivot on said pivotal means thereby releasing said locking means allowing said traverse support member to maintain each said jaws in a space apart position.

2. The one piece clip according to claim 1 wherein said pivotal means includes a means for engagement of a least one secondary jaw to at least one proximate end portion.

3. A one-piece clip, comprising:

a first jaw-element having a first, clamping portion and a second portion spaced from said first, clamping portion;

a second jaw-element having a third, clamping portion and a fourth portion spaced from said third, clamping portion;

pivot means for pivotally mounting said second jaw-element to said first jaw-element, whereby at least one of said first and third clamping portions is movable toward and away from the other of said first and third clamping portions;

biasing means for biasing at least said first clamping portion toward said third clamping portion for urging said first and third clamping portions into a closed, clamping state;

a third jaw-element having a fifth, clamping portion and a sixth portion spaced from said fifth, clamping portion;

said third jaw-element being pivotally mounted by said pivot means, said biasing means biasing said fifth, clamping portion into a closed, clamping position against one of said first jaw-element, said second jaw-element, and said pivot means, whereby the clip is provided with multiple clamping jaws.

4. The one-piece clip according to claim 3, wherein said biasing means comprises a substantially U-shaped member defining an innermost portion; said biasing means having means for holding a shaft placed within said U-shaped member.

5. The one piece clip according to claim 4, wherein said U-shaped member comprises an outer surface facing away from said first and third clamping portions, and an inner surface facing toward said first and third clamping portions, said means for a holding a shaft comprising a pair of projections protruding from said outer surface of said U-shaped member, said pair of projections being spaced apart along said outer surface; said projections being substantially juxtapositioned opposite to each other and spaced from said innermost portion of said U-shaped member and lying on laterally opposite sides of said outer surface, whereby a shaft of a hanger, and the like, may be received in said U-shaped member between said innermost portion and said pair of projections, with said pair of projections preventing the shaft from escaping.

6. The one-piece clip according to claim 3, wherein said third jaw-element is mounted above said first jaw-element, said fifth, clamping surface abutting against an outer portion of said first jaw-element; said first, third and fifth clamping portions being located on substantially the same lateral side with respect to said pivot means.

7. The one-piece clip according to claim 3, wherein said third jaw-element is connected to said second portion of said first jaw-element and extends substantially coplanar therewith, said fifth clamping portion being located on substantially the opposite lateral side with respect to said pivot means as said first and third clamping portions.

8. The one-piece clip according to claim 3, wherein said biasing means comprises an arcuate member having an innermost portion and a pair of outer ends; one of said pair of outer ends being directly connected to one of said second, fourth and sixth portions, and the outer of said pair of outer ends being directly connected to one of said second, fourth and sixth portions which is free of direct connection to said one outer end; said innermost portion being directly connected and integral with a portion of said pivot means, whereby said pivot means also acts to aid in the opening of the clip.

9. The one-piece clip according to claim 3, wherein one of said first and third clamping portions comprises an elongated opening therein for receiving at least a portion of the other of said first and third clamping portions, whereby stress-relief is provided to the clip.

10. A one-piece clip, comprising:

a first jaw-element having a first, clamping portion and a second portion spaced from said first, clamping portion;

a second jaw-element having a third, clamping portion and a fourth portion spaced from said third, clamping portion;

pivot means for pivotally mounting said second jaw-element to said first jaw-element, whereby at least one of said first and third clamping portions is movable toward and away from the other of said first and third clamping portions;

biasing means for biasing at least said first clamping portion toward said third clamping portion for urging said first and third clamping portions into a closed, clamping state;

said biasing means comprising an arcuately-shaped member defining an innermost portion; said biasing means having means for holding a shaft placed within said arcuately-shaped member; said arcuately-shaped member being approximately U-shaped;

said arcuately-shaped member comprising an outer surface facing away from said first and third, clamping portions, and an inner surface facing toward said first and third, clamping portions; said arcuately-shaped member defining an entrance-opening through which access to said innermost portion is achieved;

said means for a holding a shaft comprising a pair of projections protruding from said outer surface of said arcuately-shaped member, said pair of projection being spaced apart along said outer surface; said projections being substantially juxtapositioned opposite to each other and spaced from said innermost portion of said arcuately-shaped member, said projections also being spaced from each other in order to allow for the forcible passage of a shaft of a hanger to said innermost portion via said entrance-opening of said arcuately-shaped member, whereby a shaft of a hanger, and the like, may be received in said arcuately-shaped member between said innermost portion an said pair of projections, with said pair of projections preventing the shaft from escaping.

11. The one-piece clip according to claim 10, wherein first jaw-element is stationary and forms part of a hanger; said second jaw-element being movable toward and away from said first jaw-element; said first jaw-element having a first, cooperating mounting means spaced from said first clamping surface; and further comprising second, cooperating mounting means for cooperatively mounting said pivot means to said first, cooperating mounting means of said first jaw-element, whereby said first and second jaw-elements are assembled together.

12. The one-piece clip according to claim 11, further comprising a shaft associated with the hanger of which said first jaw-element is a part, said shaft being received in said arcuately-shaped member between said innermost portion and said pair of projections, said pair of projections preventing said shaft from escaping.

* * * * *